US009646530B2

(12) United States Patent
Hwang et al.

(10) Patent No.: US 9,646,530 B2
(45) Date of Patent: May 9, 2017

(54) ORGANIC LIGHT-EMITTING DISPLAY APPARATUS HAVING REPAIR LINES

(71) Applicant: Samsung Display Co., Ltd., Yongin, Gyeonggi-Do (KR)

(72) Inventors: Young-In Hwang, Yongin (KR); Young-Jin Cho, Yongin (KR); Dong-Gyu Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 246 days.

(21) Appl. No.: 14/197,195

(22) Filed: Mar. 4, 2014

(65) Prior Publication Data

US 2015/0109189 A1 Apr. 23, 2015

(30) Foreign Application Priority Data

Oct. 23, 2013 (KR) ..... 10-2013-0126730

(51) Int. Cl.
*G09G 3/32* (2016.01)
*G09G 3/3225* (2016.01)

(52) U.S. Cl.
CPC ... *G09G 3/3225* (2013.01); *G09G 2300/0413* (2013.01); *G09G 2300/0439* (2013.01); *G09G 2300/0819* (2013.01); *G09G 2310/0216* (2013.01); *G09G 2330/10* (2013.01)

(58) Field of Classification Search
CPC ... G09G 2300/0413; G09G 2300/0439; G09G 2300/0819; G09G 2310/0216; G09G 2330/10; G09G 3/3225
See application file for complete search history.

(56) References Cited

U.S. PATENT DOCUMENTS

2009/0243977 A1* 10/2009 Chung ..... G09G 3/3233 345/76
2012/0300165 A1* 11/2012 Zhuang ..... G02F 1/136259 349/139
2014/0292827 A1 10/2014 Kang et al.
2014/0347401 A1 11/2014 Hwang et al.

FOREIGN PATENT DOCUMENTS

JP 2003-050400 A 2/2003
JP 2007-316511 A 12/2007
KR 10-0666639 B1 1/2007
KR 10-2008-0024009 A 3/2008
KR 10-2014-0119584 10/2014
KR 10-2014-0139327 12/2014

* cited by examiner

*Primary Examiner* — Ram Mistry
(74) *Attorney, Agent, or Firm* — Lewis Roca Rothgerber Christie LLP

(57) ABSTRACT

An organic light-emitting display apparatus includes: a plurality of emitting pixels coupled to a plurality of scan lines extending in a row direction and a plurality of data lines extending in a column direction; a plurality of dummy pixels arranged in the row direction; a plurality of first repair lines extending in the column direction, that are coupled to the plurality of dummy pixels, and that are adapted to be coupled to the plurality of emitting pixels; a plurality of second repair lines extending in the column direction, and that are coupled to the plurality of dummy pixels; and a plurality of repair switching devices arranged in a matrix array and adapted to be coupled to the plurality of scan lines and the plurality of second repair lines and adapted to be coupled to the plurality of data lines.

14 Claims, 14 Drawing Sheets

ORGANIC LIGHT-EMITTING DISPLAY APPARATUS HAVING REPAIR LINES

CROSS-REFERENCE TO RELATED APPLICATION

This application claims priority to and the benefit of Korean Patent Application No. 10-2013-0126730, filed on Oct. 23, 2013, in the Korean Intellectual Property Office, the disclosure of which is incorporated herein in its entirety by reference.

BACKGROUND

1. Field

Aspects of embodiments of the present invention relate to an organic light-emitting display apparatus.

2. Description of the Related Art

In display devices, when a defect occurs in a pixel, the pixel may always emit or may not emit at all, regardless of pixel signals and data signals applied to the pixel. A pixel that always emits or does not emit at all is recognized or perceived as a bright spot or a dark spot to users. Bright spots, for example, are generally highly visible and easily recognized by users. In some instances, defective pixels may be repaired using a dummy pixel. In order to drive the dummy pixel, memory may be used in order to determine data information to be provided to the dummy pixel. Additionally, a timing controller may be adjusted in order to effectively control the timing of the dummy pixel.

SUMMARY

One or more embodiments of the present invention include an organic light-emitting display apparatus capable of repairing a defective pixel by using a dummy pixel, without additionally providing data information for driving the dummy pixel.

Additional aspects will be set forth in part in the description which follows and, in part, will be apparent from the description, or may be learned by practice of the presented embodiments.

According to one or more embodiments of the present invention, an organic light-emitting display apparatus includes a plurality of emitting pixels coupled to a plurality of scan lines extending in a row direction and a plurality of data lines extending in a column direction; a plurality of dummy pixels arranged in the row direction; a plurality of first repair lines extending in the column direction, that are coupled to the plurality of dummy pixels, and that are adapted to be coupled to the plurality of emitting pixels; a plurality of second repair lines extending in the column direction, and that are coupled to the plurality of dummy pixels; and a plurality of repair switching devices arranged in a matrix array and adapted to be coupled to the plurality of scan lines and the plurality of second repair lines and adapted to be coupled to the plurality of data lines.

Each of the plurality of emitting pixels may include an emitting device and a pixel circuit that is separably coupled to the emitting device, and each of the plurality of dummy pixels may include a dummy pixel circuit.

The pixel circuit may include: a switching transistor configured to transfer a data signal that is received via a corresponding data line from among the plurality of data lines, in response to a scan signal that is transferred via a corresponding scan line from among the plurality of scan lines; a first capacitor configured to charge a voltage that corresponds to the data signal; and a driving transistor configured to transfer a driving current to the emitting device, wherein the driving current corresponds to the voltage that is charged in the first capacitor.

The plurality of emitting pixels may include at least one defective pixel, wherein the at least one defective pixel may be electrically isolated from a corresponding pixel circuit of the at least one defective pixel, may be coupled to a corresponding first repair line from among the plurality of first repair lines, and may be coupled to a dummy pixel from among the plurality of dummy pixels at a same column via the corresponding first repair line, and a data line from among the plurality of data lines, which corresponds to the at least one defective pixel, may be coupled to the repair switching device from among the plurality of repair switching devices, which corresponds to the at least one defective pixel, and the data line may be electrically coupled to a corresponding second repair line from among the plurality of second repair lines via the corresponding repair switching device.

The pixel circuit of the at least one defective pixel may be electrically isolated from the corresponding data line.

The corresponding repair switching device may be configured to transfer a data signal that is received via the corresponding data line to the corresponding second repair line in response to a scan signal that is transferred via a scan line from among the plurality of scan lines, which corresponds to the at least one defective pixel, and the corresponding second repair line may be configured to store a dummy data voltage that corresponds to the data signal.

The corresponding second repair line may include a parasitic capacitor configured to store the dummy data voltage.

The dummy pixel circuit of the dummy pixel at a same column as the at least one defective pixel may include a dummy driving current generating circuit configured to generate a driving current that corresponds to the dummy data voltage stored in the corresponding second repair line.

The dummy driving current generating circuit may include: a dummy capacitor configured to charge a voltage that corresponds to the dummy data voltage stored in the corresponding second repair line; and a dummy driving transistor configured to transfer the driving current that corresponds to the voltage charged in the dummy capacitor to the emitting device of the at least one defective pixel.

The dummy pixel circuit may further include a dummy additional circuit coupled to the dummy capacitor and the dummy driving transistor, the dummy pixel circuit including at least one of a transistor and/or a second capacitor.

The dummy additional circuit may be coupled to a data line corresponding to the at least one defective pixel.

The organic light-emitting display apparatus may further include a dummy scan line extending in the row direction and coupled to a plurality of the dummy pixel circuits.

Each of the plurality of the dummy pixel circuits may include: a dummy switching transistor configured to transfer the dummy data voltage stored in the corresponding second repair line from among the plurality of second repair lines, in response to a dummy scan signal that is transferred via the dummy scan line; a dummy capacitor configured to charge a voltage that corresponds to the dummy data voltage; and a dummy driving transistor configured to transfer the driving current that corresponds to the voltage charged in the dummy capacitor to the emitting device of the at least one defective pixel.

Each of the plurality of the dummy pixel circuits may further include a dummy additional circuit coupled to the dummy switching transistor, the dummy capacitor, and the dummy driving transistor, and the pixel circuit may further include an additional circuit coupled to the switching transistor, the capacitor, and the driving transistor.

According to one or more embodiments of the present invention, an organic light-emitting display apparatus includes: an emitting pixel coupled to a scan line, and including a plurality of sub-emitting pixels coupled to a plurality of data lines, respectively; a dummy pixel including a plurality of sub-dummy pixels; a first repair line adapted to be coupled to the plurality of sub-dummy pixels and the plurality of sub-emitting pixels; a second repair line coupled to the plurality of sub-dummy pixels; and a repair switching device coupled to the scan line and the second repair line, and adapted to be coupled to the plurality of data lines.

The plurality of sub-emitting pixels may include sub-emitting devices and sub-pixel circuits that are separably coupled to the sub-emitting devices, respectively, and the plurality of sub-dummy pixels may include a plurality of sub-dummy pixel circuits that correspond to the sub-emitting devices, respectively.

The emitting pixel may include a defective sub-emitting pixel, a sub-emitting device of the defective sub-emitting pixel may be electrically isolated from a sub-pixel circuit of the defective sub-emitting pixel, the first repair line may be coupled to the sub-emitting device of the defective sub-emitting pixel from among the plurality of sub-emitting pixels and may be coupled to a sub-dummy pixel circuit from among the plurality of sub-dummy pixel circuits which corresponds to the defective sub-emitting pixel, and the repair switching device may be coupled to a data line from among the plurality of data lines which corresponds to the defective sub-emitting pixel.

The repair switching device may be configured to transfer a data signal received via the data line corresponding to the defective sub-emitting pixel to the second repair line, in response to a scan signal that is transferred via the scan line, and the second repair line may be configured to store a dummy data voltage that corresponds to the data signal.

The organic light-emitting display apparatus may further include a dummy scan line coupled to the plurality of sub-dummy pixel circuits, and the sub-dummy pixel circuit that corresponds to the defective sub-emitting pixel may include: a dummy switching transistor configured to transfer the dummy data voltage stored in the second repair line, in response to a dummy scan signal that is transferred via the dummy scan line; a dummy capacitor configured to charge a voltage that corresponds to the dummy data voltage; and a dummy driving transistor configured to transfer a driving current that corresponds to the voltage charged in the dummy capacitor to the sub-emitting device of the defective sub-emitting pixel.

The sub-dummy pixel circuit that corresponds to the defective sub-emitting pixel may include: a dummy capacitor configured to charge a voltage that corresponds to the dummy data voltage stored in the second repair line; and a dummy driving transistor configured to transfer a driving current that corresponds to the voltage charged in the dummy capacitor to the sub-emitting device of the defective sub-emitting pixel.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
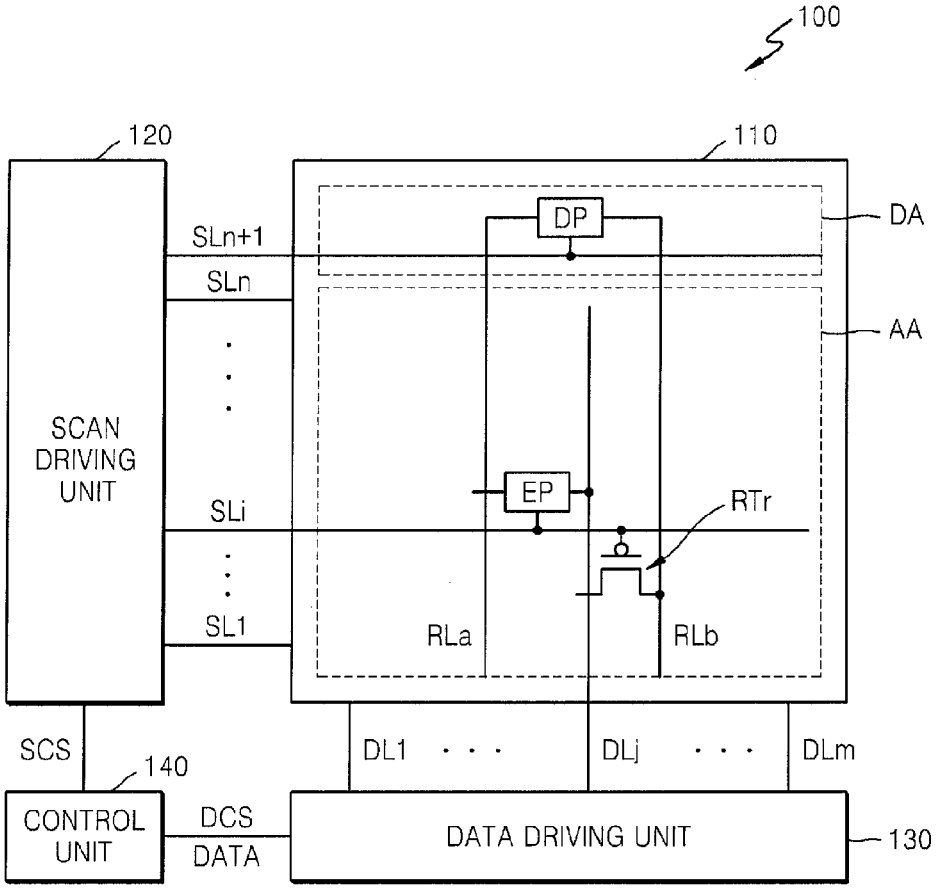
FIG. 1 is a block diagram of an organic light-emitting display apparatus according to an embodiment of the present invention.

Reference will now be made in some detail to descriptions of example embodiments, examples of which are illustrated in the accompanying drawings. In this regard, embodiments of the present invention may have different forms and should not be construed as being limited to the descriptions set forth herein. Accordingly, the example embodiments are merely described below, by referring to the figures, to explain some aspects of the present invention.

In the accompanying drawings, those components that are the same or are in correspondence are rendered the same reference numeral regardless of the figure number, and redundant explanations are omitted.

Throughout the specification, while terms "first" and "second" are used to describe various components, the components are not limited to the terms "first" and "second". The terms "first" and "second" are used only to distinguish between each component. Throughout the specification, a singular form may include plural forms, unless there is a particular description contrary thereto.

Also, terms such as "comprise" or "comprising" are used to specify existence of a recited form, and/or a component, not excluding the existence of one or more other recited forms, and/or one or more other components.

FIG. 1 is a block diagram of an organic light-emitting display apparatus 100 according to an embodiment of the present invention.

Referring to FIG. 1, the organic light-emitting display apparatus 100 includes a display panel 110, a scan driving unit 120, a data driving unit 130, and a control unit 140. The scan driving unit 120, the data driving unit 130, and the control unit 140 may be formed in individual semiconductor chips, respectively, or may be integrated in one semiconductor chip. The scan driving unit 120 and the display panel 110 may be formed on the same substrate.

The display panel 110 may have an active area AA and a dummy area DA defined thereon. The dummy area DA may be located adjacent to the active area AA.

In an embodiment, the dummy area DA is located in an upside area (e.g., the upper side of the display panel 110 in FIG. 1) or a downside area (e.g., the lower side of the display panel 110) with respect to the active area AA. In another embodiment, the dummy area DA is located in both upside and downside areas of the active area AA. In other embodiments, the dummy area DA is located in left and/or right areas of the active area AA, or upside and/or downside areas of the active area AA. The dummy area DA may have a portion located in left and/or right areas of the active area AA, and a portion located in upside and/or downside areas of the active area AA. In the present embodiment, as illustrated in FIG. 1, although the dummy area DA is illustrated as being located in an upside area of the active area AA, embodiments of the present invention are not limited thereto.

Scan lines SL1-SLn that extend in a row direction and data lines DL1-DLm that extend in a column direction are located in the active area AA. A plurality of emitting pixels EP that are coupled to the scan lines SL1-SLn and the data lines DL1-DLm are also located in the active matrix area AA and arranged in a matrix-array. The emitting pixels EP are located at positions where the scan lines SL1-SLn and the data lines DL1-DLm cross. Although one emitting pixel EP is illustrated in FIG. 1 in the active area AA and coupled to one scan line SLi and one data line DLj for convenience of illustration, the emitting pixels EP according to embodiments of the present invention are matrix-arrayed.

An organic light-emitting display apparatus capable of expressing various colors includes unit pixels each including a plurality of sub-pixels that express plurality of colors, respectively, so as to express the various colors. For example, one unit pixel may include three sub-pixels that express red (R), green (G), and blue (B) colors, respectively. Alternatively, one unit pixel may include four sub-pixels that express red (R), green (G), blue (B), and white (W) colors, respectively.

Embodiments of the present invention are not limited to a single sub pixel for each emitting pixel EP. Instead, the emitting pixel EP may indicate a unit pixel including a plurality of sub-pixels. That is, throughout the specification, the description in that one emitting pixel EP exists may mean that one sub-pixel exists or may mean that one unit pixel consisting of a plurality of sub-pixels exists.

This is the same in the dummy pixel DP. For example, the description in that one dummy pixel DP exists may mean that one unit dummy pixel exists or may mean that one unit dummy pixel consisting of a plurality of sub-dummy pixels exists.

Throughout the specification, a row direction indicates a horizontal direction in FIG. 1, and a column direction indicates a vertical direction in FIG. 1. However, embodiments of the present invention are not limited thereto, and the row direction and the column direction are not limited to the horizontal direction and the vertical direction, according to the arrangement of the organic light-emitting display apparatus 100. Throughout the specification, the row direction may indicate a direction in which the scan lines SL1-SLn extend, and the column direction may indicate a direction in which the data lines DL1-DLm extend.

In an embodiment, the emitting pixels EP are separably coupled to the data lines DL1-DLm. In another embodiment, the emitting pixels EP are separably coupled to the scan lines SL1-SLn. In the other embodiment, the emitting pixels EP are separably coupled to the data lines DL1-DLm and the scan lines SL1-SLn.

Throughout the specification, the term "separably coupled to" or "detachable coupling" means that two elements may be separated from each other or may have a structure adapted to be separated from each other by using a laser or the like in a repair process. For example, the description in which a first element and a second element are separably coupled may mean that the first element and the second element are actually coupled in an initial phase of manufacturing but they may be separated from each other in a following repair process. That is, the first element and the second element are coupled to each other in a manner that the first element and the second element are to be easily separated from each other in the following repair process. In a structural point, the first element and the second element that are separably coupled may be coupled to each other by using a conductive connection member. In the repair process, when a laser is irradiated to the conductive connection member, a part of the conductive connection member, which is laser-irradiated, is melted and then is cut, so that the first element and the second element are electrically separated and insulated or isolated. In the present embodiment, the conductive connection member may include a silicon layer that is easily melted by a laser. For the laser irradiation, another conductive member may not be located on the silicon layer. In another embodiment, the conductive connection member may be melted by a joule heat due to a current and then may be cut.

In the dummy area DA, a dummy scan line SLn+1 extending in the row direction, and a plurality of dummy pixels DP coupled to the dummy scan line SLn+1 are located. Referring to FIG. 1, the dummy pixels DP are located in one row, but one or more embodiments of the present invention are not limited thereto. In another embodiment, a plurality of dummy scan lines exist, and the dummy pixels DP may be positioned to be coupled to corresponding ones of the dummy scan lines.

First repair lines RLa and second repair lines RLb that extend in the column direction are located in the active area AA. The first repair lines RLa may be coupled to or may be adapted to be coupled to dummy pixels DP that are positioned at columns that correspond to the first repair lines RLa. The first repair lines RLa are adapted to be coupled to emitting pixels EP that are positioned at columns that correspond to the first repair lines RLa. Each of the first repair lines RLa may be a path for transferring a driving current to an emitting device of an emitting pixel EP that is coupled in a repair process, wherein the emitting pixel EP is from among the emitting pixels EP to which the first repair lines RLa may be coupled. The second repair lines RLb are coupled to the dummy pixels DP that are positioned at the columns that correspond to the second repair lines RLb. The second repair lines RLb may store dummy data voltages that respectively correspond to data signals of the dummy pixels DP that are positioned at the corresponding columns.

A plurality of repair switching devices RTr are arranged in a matrix-array in the active area AA, while the repair switching devices RTr are coupled to the scan lines SL1-SLn and the second repair lines RLb and are adapted to be coupled to the data lines DL1-DLm. Each of the repair switching devices RTr may include a thin-film transistor (TFT), and as illustrated in FIG. 1, each repair switching device RTr may be a p-type TFT. Each repair switching device RTr may include a control terminal that is coupled to a corresponding scan line SLi, a first connection terminal that is coupled to a corresponding second repair line RLb, and a second connection terminal that is adapted to be coupled to a corresponding data line DLj. In response to a signal that is input to the control terminal, the first connection terminal and the second connection terminal of each repair switching device RTr may be electrically coupled to or separated from each other. In another embodiment, the first connection terminal of each repair switching device RTr is adapted to be coupled to the corresponding second repair line RLb, and the second connection terminal is coupled to the corresponding second repair line RLb.

Throughout the specification, the terms "connectable," "coupleable," "connectably," or "adapted to be coupled" means that two elements may be coupled or connected to each other or may have a structure in which the two elements are enabled to be connected or adapted to be coupled to each other by using a laser or the like in a repair process. For example, the description in which a first element and a second element are adapted to be coupled may mean that the first element and the second element are not actually coupled in an initial phase of manufacturing but they may be coupled to each other in a following repair process. That is, the first element and the second element are separated from each other in a manner that the first element and the second element are to be easily coupled to each other in the following repair process. In a structural point, the first element and the second element that are "coupleable" with respect to each other may be coupled to a first conductive member and a second conductive member, respectively, which overlap with each other by having an insulating layer positioned therebetween in an overlapping area. In the repair process, when a laser is irradiated to the overlapping area, the insulating layer in the overlapping area is removed so that the first conductive member and the second conductive member are coupled to each other, and therefore, the first element and the second element are electrically coupled to each other. For the laser irradiation, a conductive member may not be positioned on the overlapping area.

Throughout the specification, the term "correspond" or "corresponding" is used to specify an element from among a plurality of elements, which is located at the same column or row as another element. For example, the description in which a first element is coupled or connected to a second element from among a plurality of second elements which "correspond" to the first element may mean that the first element is coupled or connected to the second element that is positioned at the same column or row as the first element. In the embodiment of FIG. 1, a scan line SLi that corresponds to an emitting pixel EP is specified as the scan line SLi that is from among the scan lines SL1-SLn and that extends along the same row as the emitting pixel EP. Also, in the embodiment of FIG. 1, a data line DLj that corresponds to the emitting pixel EP is specified as the data line DLj that is from among the data lines DL1-DLm and that extends along the same column as the emitting pixel EP.

In the present embodiment, the display panel 110 indicates a display panel of the organic light-emitting diode apparatus 100. However, one or more embodiments of the present invention are not limited thereto, and the display panel 110 may indicate a flat display panel such as a thin-film transistor liquid crystal display (TFT-LCD), a plasma display panel (PDP), a light-emitting diode (LED) display, or the like. The emitting pixel EP may include a display device and a pixel circuit that is separably coupled to the display device. The display device may include an organic emission layer (organic EML) or a liquid-crystal layer. When the display device includes the organic EML, the display device may be referred as an emitting device. In the present embodiment, as illustrated in FIG. 1, it is assumed that the display panel 110 indicates the display panel of the organic light-emitting diode apparatus 100.

The control unit 140 controls the scan driving unit 120 and the data driving unit 130, in response to a horizontal synchronization signal and a vertical synchronization signal that are provided from an external source (e.g., a timing controller). The control unit 140 generates a plurality of control signals including a scan control signal SCS and a data control signal DCS, and digital image data DATA, provides the scan control signal SCS to the scan driving unit 120, and provides the data control signal DCS and the digital image data DATA to the data driving unit 130. The control unit 140 may control a first power voltage ELVDD, a second power voltage ELVSS, an emission control signal EM, an initialization voltage Vint, or the like to be applied to the emitting pixels EP and the dummy pixels DP.

The scan driving unit 120 sequentially drives the scan lines SL1-SLn and the dummy scan line SLn+1, in response to the scan control signal SCS. For example, the scan control signal SCS may be an indication signal for controlling the scan driving unit 120 to scan the scan lines SL1-SLn and the dummy scan line SLn+1. The scan driving unit 120 may generate scan signals and may sequentially provide the scan signals to the emitting pixels EP and the dummy pixels DP via the scan lines SL1-SLn and the dummy scan line SLn+1.

The data driving unit 130 may drive the data lines DL1-DLm, in response to the data control signal DCS and the digital image data DATA that are provided from the control unit 140. The data driving unit 130 may convert the digital image data DATA having a gray level into data signals having a gray level voltage corresponding to the gray level, and may sequentially provide the data signals to the emitting pixels EP via the data lines DL1-DLm. The data driving unit 130 is not directly coupled to the dummy pixels DP. The data signals to be provided to the dummy pixels DP are stored in the form of dummy data voltages in the second repair lines RLb, and when the scan signal is applied to the dummy pixels DP, the dummy data voltages that are charged in the second repair lines RLb are provided as the data signals to the dummy pixels DP.

The data driving unit 130 does not directly provide the data signals to the dummy pixels DP, but provides the data signals only to the emitting pixels EP. Thus, although the display panel 110 is repaired, the data driving unit 130 does not have to remember an address of a repaired emitting pixel EP or to re-provide a data signal to a dummy pixel DP, wherein the data signal is supposed to be provided to the repaired emitting pixel EP. That is, although a repair process is performed, the data driving unit 130 is not repaired, and a memory to store the address of the repaired emitting pixel EP is not additionally required.

Figure 2:
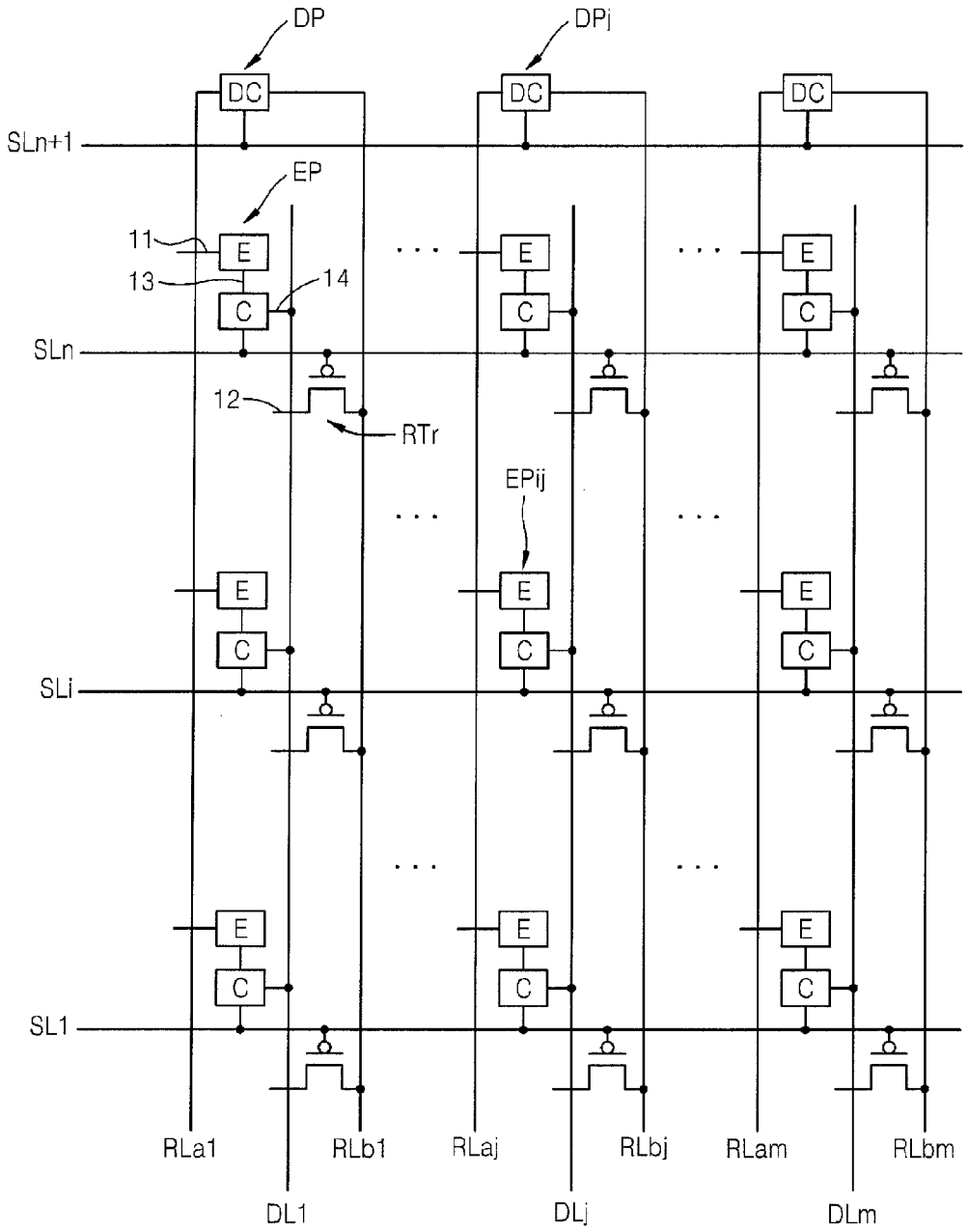
FIG. 2 illustrates an example of a display panel of FIG. 1, according to an embodiment of the present invention.

FIG. 2 illustrates an example of the display panel 110 of FIG. 1, according to an embodiment of the present invention.

Referring to FIG. 2, the display panel 110 includes a plurality of emitting pixels EP, a plurality of dummy pixels DP, a plurality of first repair lines RLa1-RLam, a plurality of second repair lines RLb1-RLbm, and a plurality of repair switching devices RTr. The emitting pixels EP are coupled to a plurality of scan lines SL1-SLn extending a row direction and a plurality of data lines DL1-DLm extending a column line, and are matrix-arrayed on the display panel 110. The dummy pixels DP are coupled to a dummy scan line SLn+1 extending the row direction, and are arrayed in the row direction on the display panel 110. The first repair lines RLa1-RLam extend in the column direction, are coupled to the dummy pixels DP, and are adapted to be coupled to the emitting pixels EP. The second repair lines RLb1-RLbm extend in the column direction, and are coupled to the dummy pixels DP. The repair switching devices RTr are coupled to the scan lines SL1-SLn and the second repair lines RLb1-RLbm, are adapted to be coupled to the data lines DL1-DLm, and are arranged in a matrix array on the display panel 110.

Each of the emitting pixels EP includes an emitting device E and a pixel circuit C that is separably coupled to the emitting device E. The emitting device E may include an organic EML that is interposed between a pixel electrode and an opposite electrode that faces the pixel electrode. Each of the dummy pixels DP includes a dummy pixel circuit DC that is coupled to a corresponding first repair line from among the first repair lines RLa1-RLam and a corresponding second repair line from among the second repair lines RLb1-RLbm.

For convenience of description, an emitting pixel EPij and a dummy pixel DPj that is positioned at the same column as the emitting pixel EPij are mainly described. The descriptions about the emitting pixel EPij and the dummy pixel DPj may be equally applied to the rest of the emitting pixels EP and dummy pixels DP.

A pixel circuit C of the emitting pixel EPij is coupled to a corresponding scan line SLi from among the scan lines SL1-SLn, and a corresponding data line DLj from among the data lines DL1-DLm. In response to a scan signal that is transferred via the corresponding scan line SLi, the pixel circuit C receives a data signal transferred via the corresponding data line DLj, generates a driving current corresponding to the data signal and then provides the driving current to the emitting device E. The emitting device E receives the driving current and emits light with a brightness corresponding to the driving current.

The emitting device E and the pixel circuit C may be coupled via a separable wire 13 that may be easily separated. The separable wire 13 may include at least a portion of a silicon layer, and in order to allow a laser to be irradiated to the silicon layer, a conductive layer may not be formed on the silicon layer.

The pixel circuit C may be separably coupled to the corresponding data line DLj. As illustrated in FIG. 2, the pixel circuit C may be coupled to the corresponding data line DLj via a separable wire 14. The separable wire 14 may include at least a portion of a silicon layer, and in order to allow a laser to be irradiated to the silicon layer, a conductive layer may not be formed on the silicon layer.

The emitting device E is adapted to be coupled to a corresponding first repair line RLaj from among the first repair lines RLa1-RLam. The emitting device E may be coupled to the first repair line RLaj via a connectable wire 11. The connectable wire 11 may include a first conductive layer and a second conductive layer that partly overlap with each other in an overlapping area by having an insulation layer interposed therebetween. The first conductive layer is coupled to the corresponding first repair line RLaj, and the second conductive layer is coupled to the emitting device E. When a laser is irradiated to the overlapping area, the insulation layer of the overlapping area is removed so that the first and second conductive layers contact each other and therefore the emitting device E and the corresponding first repair line RLaj are electrically coupled to each other. Before the laser irradiation, the first conductive layer and the second conductive layer of the connectable wire 11 are insulated from each other due to the insulation layer, therefore, before a repair process starts, the emitting device E and the corresponding first repair line RLaj are insulated from each other, and only after the repair process starts, the emitting device E and the corresponding first repair line RLaj may be coupled to each other.

Each of the repair switching devices RTr may include a p-type TFT. Each repair switching device RTr may include a control terminal that is coupled to the corresponding scan line SLi, a first connection terminal that is coupled to a corresponding second repair line RLbj, and a second connection terminal that is adapted to be coupled to the corresponding data line DLj. The second connection terminal may be coupled to the corresponding data line DLj via a connectable wire 12. That is, the second connection terminal and the data line DLj are insulated from each other and may be coupled to each other via the repair process.

The corresponding first repair line RLaj and the corresponding second repair line RLbj are coupled to the dummy pixel DPj that is located at the same column as the emitting pixel EPij.

Figure 3:
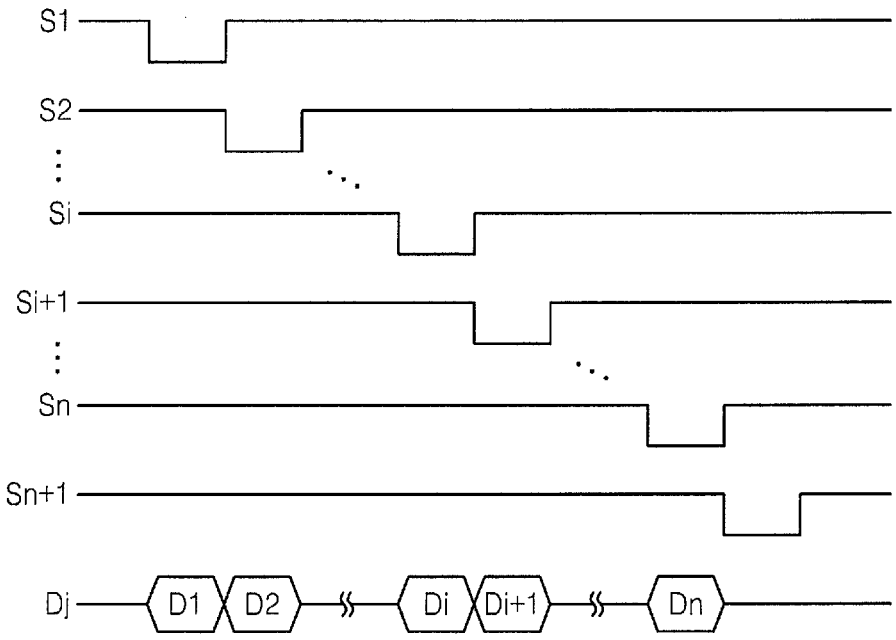
FIG. 3 illustrates waveforms indicating scan signals and data signals that are supplied to the display panel shown in FIG. 2.

FIG. 3 illustrates waveforms indicating scan signals S1-Sn+1 and data signals D1-Dn that are supplied to the display panel 110 shown in FIG. 2.

Referring to FIG. 3, the scan driving unit 120 sequentially applies the scan signals S1-Sn+1 to first through $n^{th}$ scan lines SL1-SLn and a dummy scan line SLn+1. The data driving unit 130 sequentially applies the data signals D1-Dn that are synchronized with the scan signals S1-Sn+1, respectively, to data lines DL1-DLm. When the scan signal Sn+1 is applied to the dummy scan line SLn+1, the data driving unit 130 does not apply any data signal. Dummy pixels DP that are activated by the scan signal Sn+1 generate driving currents, respectively, based on dummy data voltages that are charged in the second repair lines RLb1-RLbm, and supply the driving currents to emitting devices of repaired emitting pixels, respectively. The repaired emitting pixels emit light, in response to the driving currents.

Because the data driving unit 130 does not directly apply a data signal to the dummy pixels DP, although emitting pixels EP are repaired, it is not necessary to adjust the data driving unit 130.

Referring to FIG. 3, a pulse width of a scan signal corresponds to 1 horizontal time 1H but one or more embodiments of the present invention are not limited thereto. The pulse width of the scan signal may correspond to 2 horizontal time periods 2H. Pulse widths of neighbouring scan signals, e.g., a pulse width of an $n-1_{th}$ scan signal Sn−1 and a pulse width of an $n_{th}$ scan signal Sn may overlap with each other by about 1H or less. Accordingly, a charging shortage problem caused by an RC delay of a signal line due to a large display area may be solved or decreased.

Figure 4:
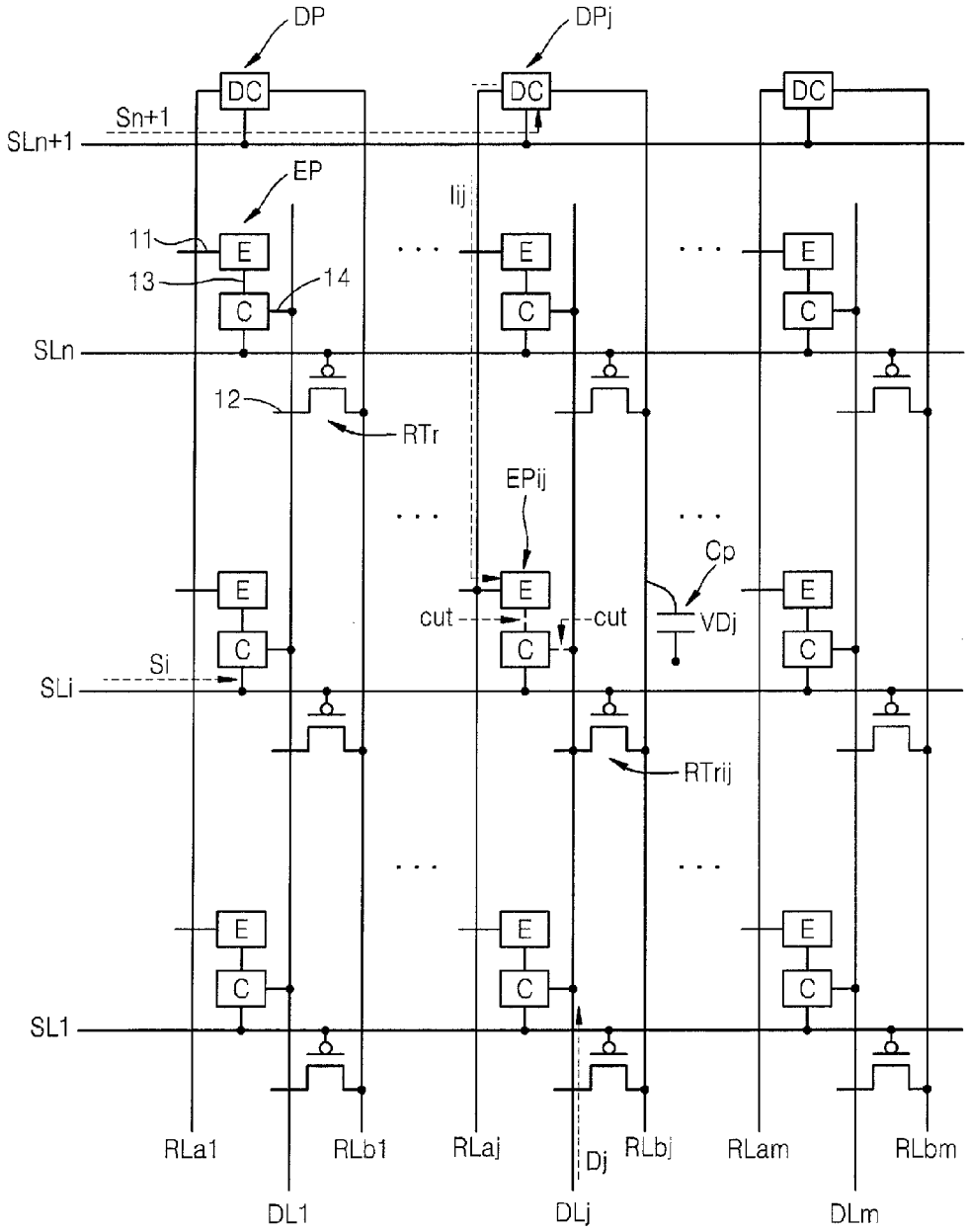
FIG. 4 illustrates a method of repairing a defective pixel in the display panel shown in FIG. 2.

FIG. 4 illustrates a method of repairing a defective pixel in the display panel 110 shown in FIG. 2.

Referring to FIG. 4, each of emitting pixels EP includes an emitting device E and a pixel circuit C that is separably coupled to the emitting device E. Each of dummy pixels DP includes a dummy pixel circuit DC.

It is assumed that an emitting pixel EPij that is coupled to a scan line SLi and a data line DLj is a defective pixel, and hereinafter, the emitting pixel EPij that is the defective pixel is referred as a defective pixel EPij. The defective pixel EPij is repaired by using a dummy pixel DPj and therefore normally operates.

The emitting device E of the defective pixel EPij is separated from the pixel circuit C. For example, the emitting device E and the pixel circuit C of the defective pixel EPij may be separated by using laser cutting. For example, a laser is irradiated to a silicon layer of a separable wire 13 that electrically couples the emitting device E and the pixel circuit C of the defective pixel EPij, and then the silicon layer of the separable wire 13 is melted, so that both terminals of the separable wire 13 may be electrically separated. As a result, the emitting device E and the pixel circuit C of the defective pixel EPij may be electrically insulated.

In an embodiment, the pixel circuit C of the defective pixel EPij may be separated from the data line DLj. For example, laser cutting may be used. The pixel circuit C of the defective pixel EPij may be coupled to the data line DLj via a separable wire 14. When a laser is irradiated to a silicon layer of the separable wire 14, the pixel circuit C of the defective pixel EPij may be insulated or electrically isolated from the data line DLj. According to a defection reason of the pixel circuit C of the defective pixel EPij, the pixel circuit C may not be separated from the data line DLj.

A first repair line RLaj is coupled to the emitting device E of the defective pixel EPij. The emitting device E of the defective pixel EPij may be coupled to the first repair line RLaj via a connectable wire 11. That is, before a repair process starts, the emitting device E is electrically insulated from the first repair line RLaj, but when a laser is irradiated to an overlapping area of the connectable wire 11 in the repair process starts, the emitting device E is electrically coupled to the dummy pixel circuit DC of the dummy pixel DPj.

A repair switching device RTrij that corresponds to the defective pixel EPij is coupled to the data line DLj. For example, a laser may be used. A second connection terminal of the repair switching device RTrij is coupled to the data line DLj via a connectable wire 12. When a laser is irradiated to an overlapping area of the connectable wire 12, an insulation layer of the overlapping area is removed, so that both terminals of the connectable wire 12 are electrically coupled to each other, and as a result, the second connection terminal of the repair switching device RTrij and the data line DLj are electrically coupled to each other.

When a scan signal Si that is transferred via the scan line SLi is activated, a data signal Dj is applied to the data line DLj. In response to the scan signal Si, the repair switching device RTrij transfers the data signal Dj to a second repair line RLbj. The second repair line RLbj includes a parasitic capacitor Cp that equivalently exists. The parasitic capacitor Cp stores a dummy data voltage VDj that corresponds to the data signal Dj.

When a scan signal Sn+1 is activated via a dummy scan line SLn+1, the dummy pixel circuit DC of the dummy pixel DPj receives the dummy data voltage VDj charged in the parasitic capacitor Cp, and generates a driving current Iij that corresponds to the dummy data voltage VDj. The dummy pixel circuit DC provides the driving current Iij to the emitting device E of the defective pixel EPij. The emitting device E of the defective pixel EPij emits light, based on the driving current Iij. Because the driving current Iij corresponds to the data signal Dj, the emitting device E of the defective pixel EPij emits light with a brightness corresponding to the data signal Dj, so that the defective pixel EPij is repaired to a normal emitting pixel.

Referring to FIG. 4, the dummy pixels DP are arrayed at one row, so that one defective pixel at every column may be repaired by using the dummy pixel DP. In another embodiment, when dummy pixels are located at a top row and a bottom row, two defective pixels at every column may be repaired. In this case, the first and second repair lines RLa and RLb may be separated into two parts between the two defective pixels.

Figure 5:
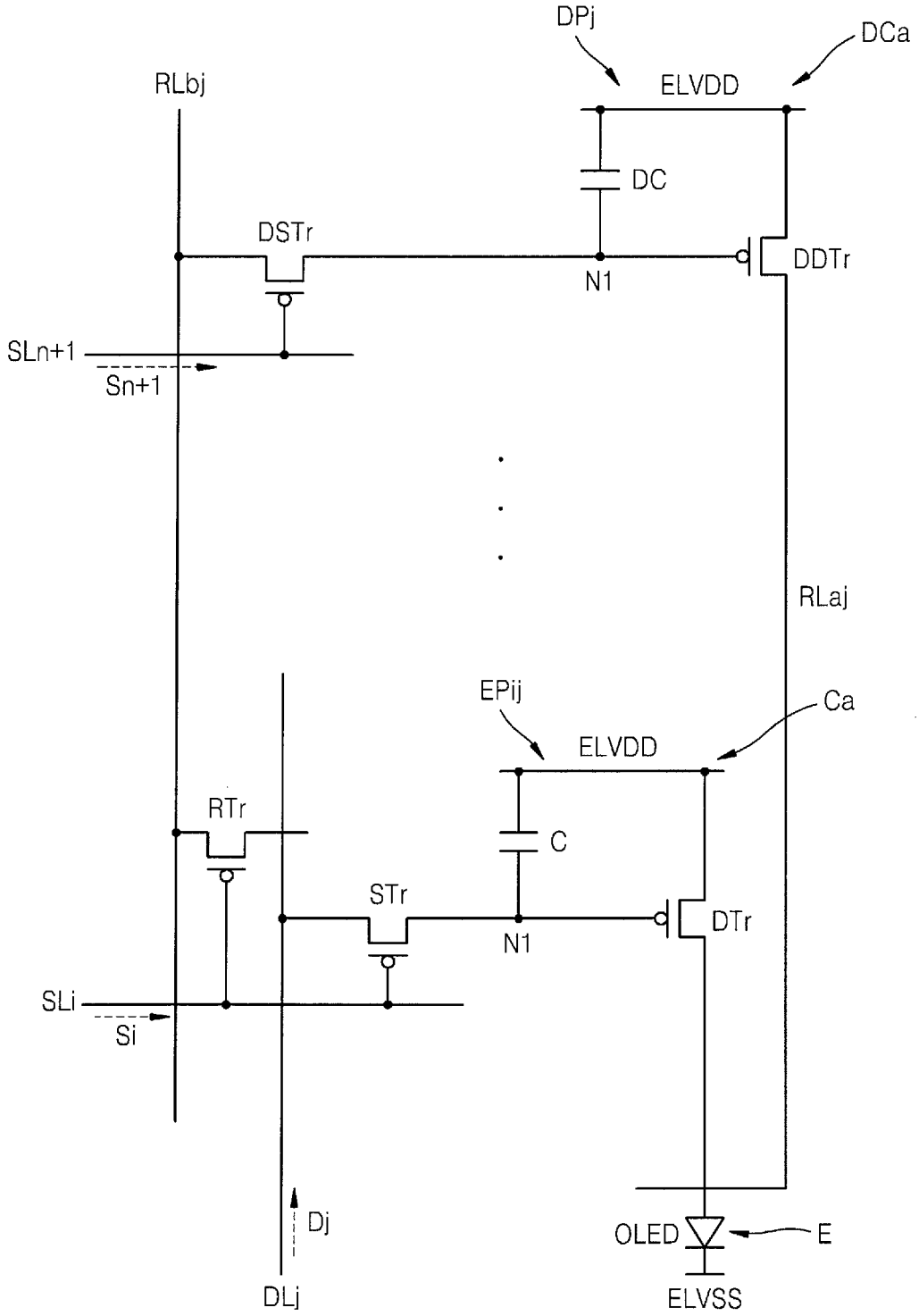
FIG. 5 illustrates a circuit configuration of an emitting pixel and a dummy pixel that may be applied to the display panel shown in FIG. 2, according to an embodiment of the present invention.

FIG. 5 illustrates a circuit configuration of an emitting pixel EPij and a dummy pixel DPj that may be applied to the display panel 110 shown in FIG. 2, according to an embodiment of the present invention.

Referring to FIG. 5, the emitting pixel EPij includes an emitting device E, and a pixel circuit Ca for supplying a driving current to the emitting device E. The dummy pixel DPj includes a dummy pixel circuit DCa having substantially the same configuration as the pixel circuit Ca. The description about the pixel circuit Ca is equally applied to the dummy pixel circuit DCa, and is now briefly provided as below.

The emitting device E includes an anode electrode, a cathode electrode, and an organic light emitting diode OLED including an EML interposed between the anode electrode and the cathode electrode. The anode electrode is coupled to the pixel circuit Ca, and a second power voltage ELVSS supplied from a second power source is applied to the cathode electrode.

The pixel circuit Ca includes two transistors, i.e., a switching transistor STr and a driving transistor DTr, and one capacitor C.

The switching transistor STr includes a gate electrode coupled to a scan line SLi, a first electrode coupled to a data line DLj, and a second electrode coupled to a first node N1.

The driving transistor DTr includes a gate electrode coupled to the first node N1, a first electrode receiving a first power voltage ELVDD from a first power source, and a second electrode coupled to an anode electrode of the emitting device E.

The capacitor C includes a first electrode coupled to the first node N1, and a second electrode receiving the first power voltage ELVDD from the first power source.

The switching transistor STr transfers a data signal Dj from the data line DLj to the capacitor C, in response to a scan signal Si that is transferred via the scan line SLi. The capacitor C is charged with a voltage that corresponds to the data signal Dj. A driving current that corresponds to the voltage charged in the capacitor C is transferred to the emitting device E via the driving transistor DTr, so that the emitting device E emits light.

The dummy pixel circuit DCa also includes two dummy transistors, (a dummy switching transistor DSTr and a dummy driving transistor DDTr), and one dummy capacitor DC. The dummy switching transistor DSTr and the dummy driving transistor DDTr correspond to the switching transistor STr and the driving transistor DTr, respectively, and the dummy capacitor DC corresponds to the capacitor C. Hereinafter, differences are mainly described as below.

A gate electrode of the dummy switching transistor DSTr is coupled to a dummy scan line SLn+1, and a first electrode of the dummy switching transistor DSTr is coupled to a second repair line RLbj. A second electrode of the dummy driving transistor DDTr is coupled to a first repair line RLaj. As described above, the first repair line RLaj is adapted to be coupled to the anode electrode of the emitting device E.

A repair switching device RTr includes a gate electrode coupled to the scan line SLi, a first electrode coupled to a second repair line RLbj, and a second electrode adapted to be coupled to the data line DLj.

When a defect occurs in the pixel circuit Ca of the emitting pixel EPij, the pixel circuit Ca and the emitting device E are separated. The first repair line RLaj is coupled to the anode electrode of the emitting device E, and the second electrode of the repair switching device RTr is coupled to the data line DLj. In the present embodiment, the pixel circuit Ca is separated from the data line DLj.

When the scan signal Si is activated, the data signal Dj is transferred to the second repair line RLbj via the repair switching device RTr. The second repair line RLbj stores a dummy data voltage that corresponds to the data signal Dj. When the scan signal Sn+1 is activated, the dummy switching transistor DSTr transfers the dummy data voltage charged in the second repair line RLbj to the dummy capacitor DC. The dummy capacitor DC charges a voltage that corresponds to the dummy data voltage, and the dummy driving transistor DDTr generates a driving current that corresponds to the voltage charged in the dummy capacitor DC, and then supplies the driving current to the emitting device E. The emitting device E emits light according to the driving current that is provided by the dummy driving transistor DDTr of the dummy pixel circuit DCa.

Referring to FIG. 5, each of the pixel circuit Ca and the dummy pixel circuit DCa has a 2Tr-1Cap configuration including two transistors and one capacitor. However, one or more embodiments of the present invention are not limited thereto. Thus, each of the pixel circuit Ca and the dummy pixel circuit DCa may include two or more TFTs and one or more capacitors, and may be variously amended by having further wires or omitting existing wires.

Figure 6:
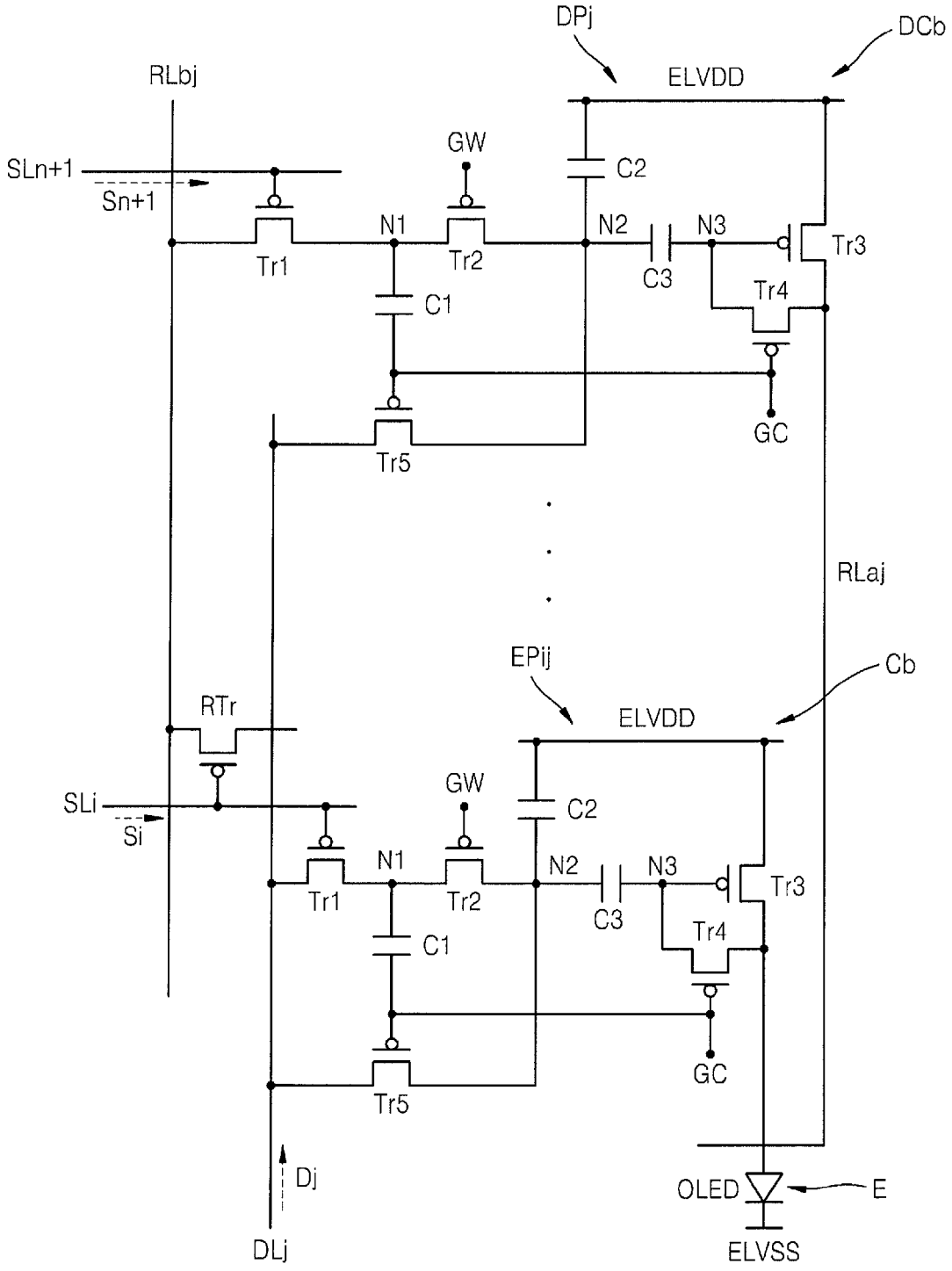
FIG. 6 illustrates a circuit configuration of an emitting pixel and a dummy pixel that may be applied to the display panel shown in FIG. 2, according to another embodiment of the present invention.

FIG. 6 illustrates a circuit configuration of an emitting pixel EPij and a dummy pixel DPj that may be applied to the display panel 110 shown in FIG. 2, according to another embodiment of the present invention.

Referring to FIG. 6, the emitting pixel EPij includes an emitting device E, and a pixel circuit Cb for supplying a current to the emitting device E. The dummy pixel DPj includes a dummy pixel circuit DCb having substantially the same configuration as the pixel circuit Cb. The emitting device E is equal to that shown in FIG. 5, thus, the descriptions thereof are omitted here.

The pixel circuit Cb includes five transistors, i.e., first through fifth transistors Tr1-Tr5, and three capacitors, i.e., first through third capacitors C1-C3.

The first transistor Tr1 includes a gate electrode that is coupled to a scan line SLi and therefore receives a scan signal Si, a first electrode that is coupled to a data line DLj and therefore receives a data signal Dj, and a second electrode that is coupled to a first node N1. The first transistor Tr1 may be referred as a switching transistor.

The second transistor Tr2 includes a gate electrode that receives a first control signal GW, a first electrode that is coupled to the first node N1, and a second electrode that is coupled to a second node N2.

The third transistor Tr3 includes a gate electrode that is coupled to a third node N3, a first electrode that receives a first power voltage ELVDD from a first power source, and a second electrode that is coupled to an anode electrode of an organic light emitting diode OLED. The third transistor Tr3 may be referred as a driving transistor.

The fourth transistor Tr4 includes a gate electrode that receives a second control signal GC, a first electrode that is coupled to the third node N3, and a second electrode that is coupled to the anode electrode of the organic light emitting diode OLED.

The fifth transistor Tr5 includes a gate electrode that receives the second control signal GC, a first electrode that is coupled to the data line DLj and therefore receives the data signal Dj, and a second electrode that is coupled to the second node N2.

The first capacitor C1 is coupled between the first node N1 and the gate electrode of the fifth transistor Tr5, the second capacitor C2 is coupled between the second node N2 and the first power source, and the third capacitor C3 is coupled between the second node N2 and the third node N3. When the first transistor Tr1 is turned on, the first capacitor C1 charges a voltage that corresponds to the data signal Dj that is provided from the data line DLj.

In the present embodiment, the second transistor Tr2, the fourth transistor Tr4, the fifth transistor. Tr5, the second capacitor C2, and the third capacitor C3 may be collectively referred as additional circuits arranged to compensate for deviation of a threshold voltage of the third transistor Tr3 and to perform concurrent (e.g., simultaneous) emission.

In an initialization period, the first power voltage ELVDD has a low level, and a second power voltage ELVSS has a high level. The first control signal GW and the second control signal GC have a high level. The first, second, fourth, and fifth transistors Tr1, Tr2, Tr4, and Tr5 are turned off, and the anode electrode of the organic light emitting diode OLED is initialized by the second power voltage ELVSS having the high level.

In a compensation period, the first power voltage ELVDD and the second power voltage ELVSS have a high level. The first control signal GW has a high level, and the second control signal GC has a low level. The fifth transistor Tr5 is turned on, and an auxiliary voltage Vsus having a high level is applied to the data line DLj, so that the second node N2 has the auxiliary voltage Vsus. The fourth transistor Tr4 is turned on, so that the third transistor Tr3 is diode-coupled. Until a voltage level of the gate electrode of the third transistor Tr3 becomes a voltage ELVDD−Vth that is obtained by subtracting a threshold voltage Vth of the third transistor Tr3 from the first power voltage ELVDD, a current flows via the third transistor Tr3 that is diode-coupled.

In a data transfer period, the first power voltage ELVDD and the second power voltage ELVSS remain the high level, the first control signal GW has a low level, and the second control signal GC has a high level. When the second transistor Tr2 is turned on, a voltage that corresponds to the data signal Dj written to the emitting pixel EPij during a scan period of a previous frame (e.g., an N−1 frame) and stored in the first capacitor C1 is transferred to the second node N2.

During scan/emission periods, the scan period and the emission period concurrently (e.g., simultaneously) proceed. During the scan/emission periods, the first power voltage ELVDD maintains the high level, and the second power voltage ELVSS has a low level. The first control signal GW and the second control signal GC have a high level. When the scan signal Si having a low level is received via the scan line SLi, the first transistor Tr1 is turned on, so that the data signal Dj is input to the emitting pixel EPij that is coupled to the scan line SLi. Accordingly, the first capacitor C1 stores a voltage that corresponds to the data signal Dj of a current frame (e.g., an N frame).

The second transistor Tr2 is turned off and therefore blocks the first node N1 and the second node N2. A current path between the first power voltage ELVDD and the cathode electrode of the organic light emitting diode OLED is established via the third transistor Tr3 that is turned on, and the organic light emitting diode OLED emits light with a brightness corresponding to the data signal Dj that is written to the emitting pixel EPij during the scan period of the previous frame (e.g., the N−1 frame). Here, all of the emitting pixels EP in the display panel 110 concurrently (e.g., simultaneously) emit light.

The dummy pixel circuit DCb includes five transistors (first through fifth transistors Tr1-Tr5), and three capacitors (first through third capacitors C1-C3). Except that, in the dummy pixel circuit DCb, a gate electrode of the first transistors Tr1 is coupled to the dummy scan line SLn+1 and a first electrode of the first transistor Tr1 is coupled to the second repair line RLbj, and a second electrode of the third transistor Tr3 is adapted to be coupled to an anode electrode of an emitting device E, the dummy pixel circuit DCb has the same configuration as the pixel circuit Cb. A first electrode of the fifth transistor Tr5 of the dummy pixel circuit DCb is not coupled to the first electrode of the first transistors Tr1 but is coupled to the data line DLj.

A repair switching device RTr includes a gate electrode that is coupled to the scan line SLi, a first electrode that is coupled to the second repair line RLbj, and a second electrode that is adapted to be coupled to the data line DLj.

When a defect occurs in the pixel circuit Cb of the emitting pixel EPij, the pixel circuit Cb and the emitting device E are separated. A first repair line RLaj is coupled to the anode electrode of the emitting device E, and the second electrode of the repair switching device RTr is coupled to the data line DLj. The first electrode of the first transistor Tr1 of the pixel circuit Cb is separated from the data line DLj, and the first electrode of the fifth transistor Tr5 of the pixel circuit Cb may be separated from the data line DLj.

When the scan signal Si is activated during the scan/emission periods of the previous frame, the data signal Dj is transferred to the second repair line RLbj via the repair switching device RTr. The second repair line RLbj stores a dummy data voltage that corresponds to the data signal Dj. When the scan signal Sn+1 is activated, a first transistor Tr1 of a dummy pixel DPj transfers the dummy data voltage that is charged in the second repair line RLbj to the first capacitor C1 of the dummy pixel DPj. The capacitor C1 of the dummy pixel DPj charges a voltage that corresponds to the dummy data voltage. Similarly to the pixel circuit Cb, in the dummy pixel circuit DCb, an initialization period, a compensation period, and a data transfer period proceed. During the data transfer period, the voltage that is charged in the first capacitor C1 of the dummy pixel DPj is transferred to the second node N2, during the scan/emission periods, the third transistor Tr3 of the dummy pixel circuit DCb is turned on and therefore a current path between the first power voltage ELVDD and the cathode electrode of the organic light emitting diode OLED of the emitting pixel EPij is established, and the organic light emitting diode OLED of the emitting pixel EPij emits light with a brightness corresponding to the data signal Dj that is received during the scan/emission periods of the previous frame.

Figure 7:
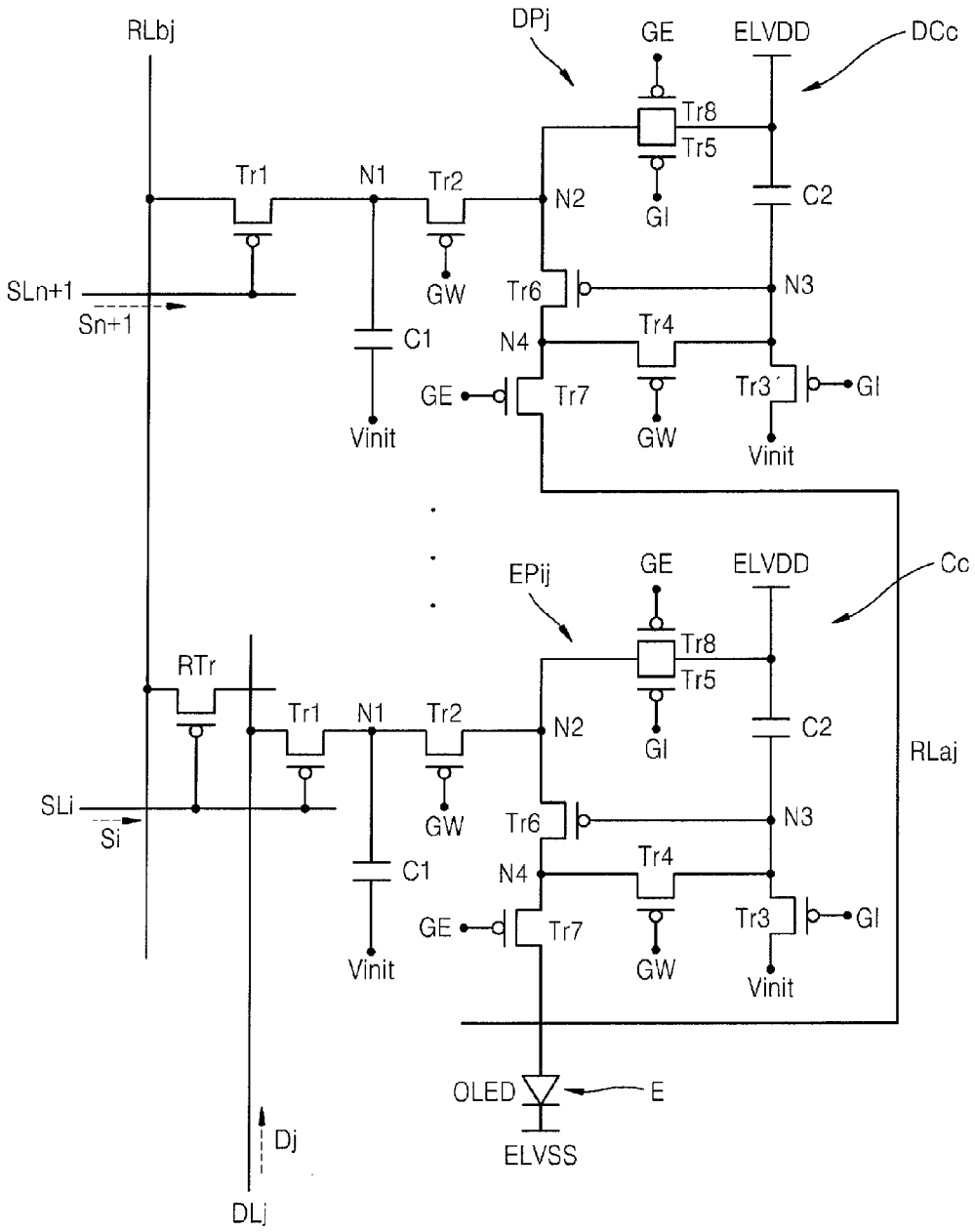
FIG. 7 illustrates a circuit configuration of an emitting pixel and a dummy pixel that may be applied to the display panel shown in FIG. 2, according to another embodiment of the present invention.

FIG. 7 illustrates a circuit configuration of an emitting pixel EPij and a dummy pixel DPj that may be applied to the display panel 110 shown in FIG. 2, according to another embodiment of the present invention.

Referring to FIG. 7, the emitting pixel EPij includes an emitting device E, and a pixel circuit Cc for supplying a current to the emitting device E. The dummy pixel DPj includes a dummy pixel circuit DCc having the substantially same configuration as the pixel circuit Cc. The emitting device E is equal to that shown in FIG. 5, thus, the descriptions thereof are omitted here.

The pixel circuit Cc includes eight transistors (first through eighth transistors Tr1-Tr8), and two capacitors (first and second capacitors C1 and C2).

The first transistor Tr1 includes a gate electrode that is coupled to a scan line SLi and therefore receives a scan signal Si, a first electrode that is coupled to a data line DLj and therefore receives a data signal Dj, and a second electrode that is coupled to a first node N1. The first transistor Tr1 may be referred as a switching transistor.

The second transistor Tr2 includes a gate electrode that receives a first control signal GW, a first electrode that is coupled to the first node N1, and a second electrode that is coupled to a second node N2.

The third transistor Tr3 includes a gate electrode that receives a second control signal GI, a first electrode that is coupled to a third node N3, and a second electrode that is coupled to an initialization power source and therefore receives an initialization voltage Vint.

The fourth transistor Tr4 includes a gate electrode that receives the first control signal GW, a first electrode that is coupled to a fourth node N4, and a second electrode that is coupled to the third node N3.

The fifth transistor Try includes a gate electrode that receives the second control signal GI, a first electrode that is coupled to a first power source and therefore receives a first power voltage ELVDD, and a second electrode that is coupled to the second node N2.

The sixth transistor Tr6 includes a gate electrode that is coupled to the third node N3, a first electrode that is coupled to the second node N2, and a second electrode that is coupled to the fourth node N4. The sixth transistor Tr6 may be referred as a driving transistor.

The seventh transistor Tr7 includes a gate electrode that receives a third control signal GE, a first electrode that is coupled to the fourth node N4, and a second electrode that is coupled to an anode electrode of an organic light emitting diode OLED.

The eighth transistor Tr8 includes a gate electrode that receives the third control signal GE, a first electrode that is coupled to the first power source and therefore receives the first power voltage ELVDD, and a second electrode that is coupled to the second node N2.

The first capacitor C1 is coupled between the first node N1 and the initialization power source that supplies the voltage Vint. The first capacitor C1 charges a voltage that corresponds to a data signal Dj supplied from a data line DLj when the first transistor Tr1 is turned on. The initialization power source may be a fixed power source (e.g., a direct current (DC) power source) having an initialization voltage level (e.g., a predetermined voltage level). For example, the initialization power source may be a first power source that provides the first power voltage ELVDD. The second capacitor C2 is coupled between the third node N3 and the first power source that provides the first power voltage ELVDD.

In the present embodiment, the second through fifth transistors Tr2-Tr5, the seventh and eighth transistors Tr7 and Tr8, and the second capacitor C2 may be collectively referred as additional circuits or circuit components arranged to compensate for deviation of a threshold voltage of the sixth transistor Tr6 and to perform concurrent (e.g., simultaneous) emission.

In an initialization period, the first power voltage ELVDD has a high level, and a second power voltage ELVSS and the second control signal GI have a low level. The third transistor Tr3 and the fifth transistor Tr5 are turned on. The first power voltage ELVDD is applied to the second node N2, and the voltage Vint is applied to the third node N3.

In compensation/data transfer periods, the first power voltage ELVDD, the second power voltage ELVSS, and the first control signal GW have a low level. The second transistor Tr2 is turned on, and then the second node N2 has a voltage that corresponds to the data signal Dj written to the emitting pixel EPij during a scan period of a previous frame and stored in the first capacitor C1. The fourth transistor Tr4 is turned on and therefore the sixth transistor Tr6 is diode-coupled. Until the third node N3 has a voltage that is obtained by subtracting a threshold voltage Vth of the sixth transistor Tr6 from the voltage of the second node N2, a current flows via the sixth transistor Tr6 that is diode-coupled. The second capacitor C2 stores a difference between the driving voltage ELVDD and the voltage of the third node N3.

In scan/emission periods, the scan period and the emission period concurrently (e.g., simultaneously) proceed. In the scan/emission periods, the first power voltage ELVDD has a high level, and the second power voltage ELVSS and the third control signal G3 have a low level. When the scan signal Si with a low level is received via the scan line SLi, the first transistor Tr1 is turned on, and the data signal Dj of a current frame is input to the emitting pixel EPij that is coupled to the scan line SLi. The first capacitor C1 stores a voltage that corresponds to the data signal Dj of the current frame.

The second transistor Tr2 is turned off and therefore the first node N1 and the second node N2 are blocked with respect to each other. The seventh transistor Tr7 and the eighth transistor Tr8 are turned on and therefore a current path between the first power voltage ELVDD and a cathode electrode of the organic light emitting diode OLED are established via the sixth transistor Tr6 that is turned on. The organic light emitting diode OLED emits light with a brightness that corresponds to the data signal Dj that was written to the emitting pixel EPij during the scan period of the previous frame and was stored in the second capacitor C2. All emitting pixels EP in the display panel 110 concurrently (e.g., simultaneously) emit light.

The dummy pixel circuit DCc includes eight transistors (first through eighth transistors Tr1-Tr8), and two capacitors (first and second capacitors C1 and C2). Except that, in the dummy pixel circuit DCc, a gate electrode of the first transistors Tr1 is coupled to the dummy scan line SLn+1 and a first electrode of the first transistor Tr1 is coupled to the second repair line RLbj, and a second electrode of the seventh transistor Tr7 is coupled to an anode electrode of an emitting device E, the dummy pixel circuit DCc has the same configuration as the pixel circuit Cc.

A repair switching device RTr includes a gate electrode that is coupled to the scan line SLi, a first electrode that is coupled to the second repair line RLbj, and a second electrode that is adapted to be coupled to the data line DLj.

When a defect occurs in the pixel circuit Cc of the emitting pixel EPij, the pixel circuit Cc and the emitting device E are separated. A first repair line RLaj is coupled to the anode electrode of the emitting device E, and the second electrode of the repair switching device RTr is coupled to the data line DLj. The first electrode of the first transistor Tr1 of the pixel circuit Cc may be separated from the data line DLj.

When the scan signal Si is activated during the scan/emission periods of the previous frame, the data signal Dj is transferred to the second repair line RLbj via the repair switching device RTr. The second repair line RLbj stores a dummy data voltage that corresponds to the data signal Dj. When the scan signal Sn+1 is activated, a first transistor Tr1 of a dummy pixel DPj transfers the dummy data voltage that is charged in the second repair line RLbj to the first capacitor C1 of the dummy pixel DPj. The capacitor C1 of the dummy pixel DPj charges a voltage that corresponds to the dummy data voltage. Similarly to the pixel circuit Cc, in the dummy pixel circuit DCc, an initialization period, a compensation period, and a data transfer period proceed. During the data transfer period, the voltage that is charged in the first capacitor C1 of the dummy pixel DPj is transferred to the second node N2, during the scan/emission periods, the sixth transistor Tr6 of the dummy pixel circuit DCc is turned on and therefore a current path between the first power voltage ELVDD and the cathode electrode of the organic light emitting diode OLED of the emitting pixel EPij is established, and the organic light emitting diode OLED of the emitting pixel EPij emits light with a brightness corresponding to the data signal Dj that is received during the scan/emission periods of the previous frame.

The pixel circuits shown in FIGS. 5 through 7 are examples that may be applied to one or more embodiments of the present invention. However, one or more embodiments of the present invention are not limited to the pixel circuits, thus, pixel circuits having other configurations may be applied thereto.

Figure 8:
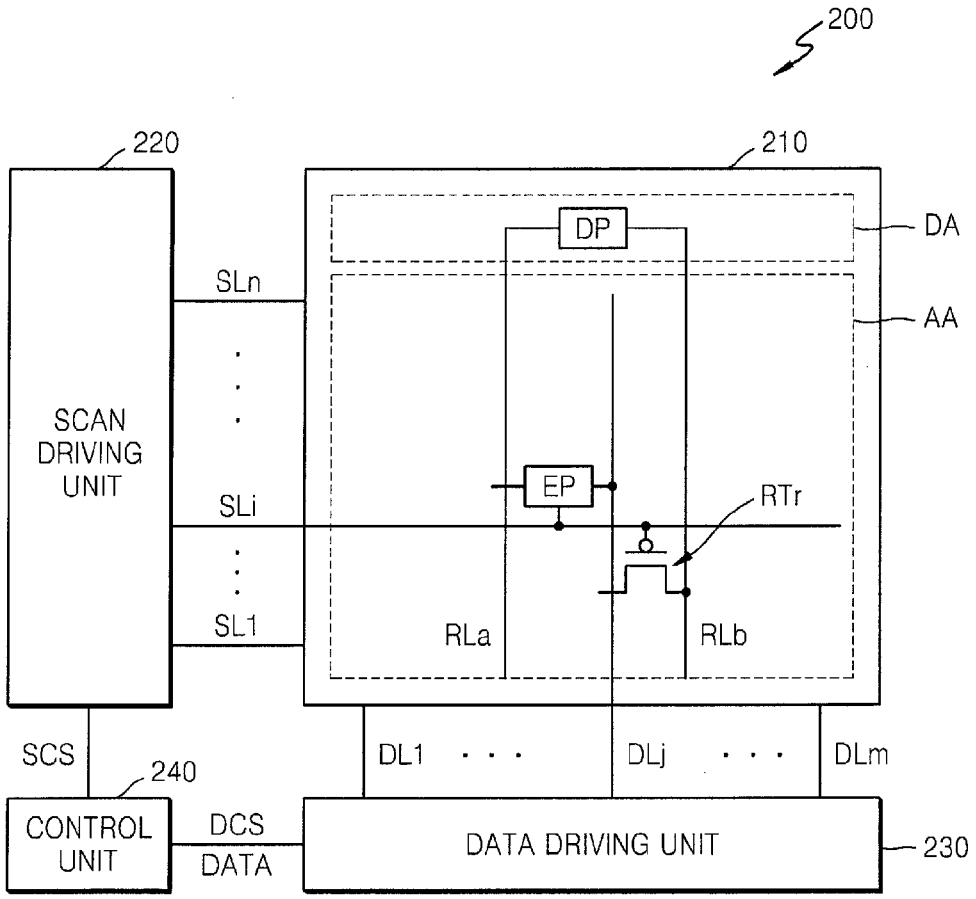
FIG. 8 is a block diagram of an organic light-emitting display apparatus according to another embodiment of the present invention.

FIG. 8 is a block diagram of an organic light-emitting display apparatus 200 according to another embodiment of the present invention.

Referring to FIG. 8, the organic light-emitting display apparatus 200 includes a display panel 210, a scan driving unit 220, a data driving unit 230, and a control unit 240. The display panel 210, the scan driving unit 220, the data driving unit 230, and the control unit 240 correspond to a display panel 110, a scan driving unit 120, a data driving unit 130, and a control unit 140 of FIG. 1, respectively, and hereinafter, differences therebetween will be provided.

A dummy scan line is not located in a dummy area DA, but a plurality of dummy pixels DP may be arranged in an array in a row direction in the dummy area DA. Timing is not separately applied to the dummy pixels DP, and the dummy pixels DP operate at the same timing with repaired emitting pixels EP in an active area AA.

The scan driving unit 220 sequentially drives scan lines SL1-SLn, in response to a scan control signal SCS. The scan driving unit 220 may generate scan signals response to the scan control signal SCS, and therefore may sequentially provide the scan signals to emitting pixels EP via the scan lines SL1-SLn.

According to the present embodiment, it is not required to adjust the data driving unit 230 or to add a memory, and also, it is not required to adjust the scan driving unit 220 so as to apply separate timing to the dummy pixels DP.

Figure 9:
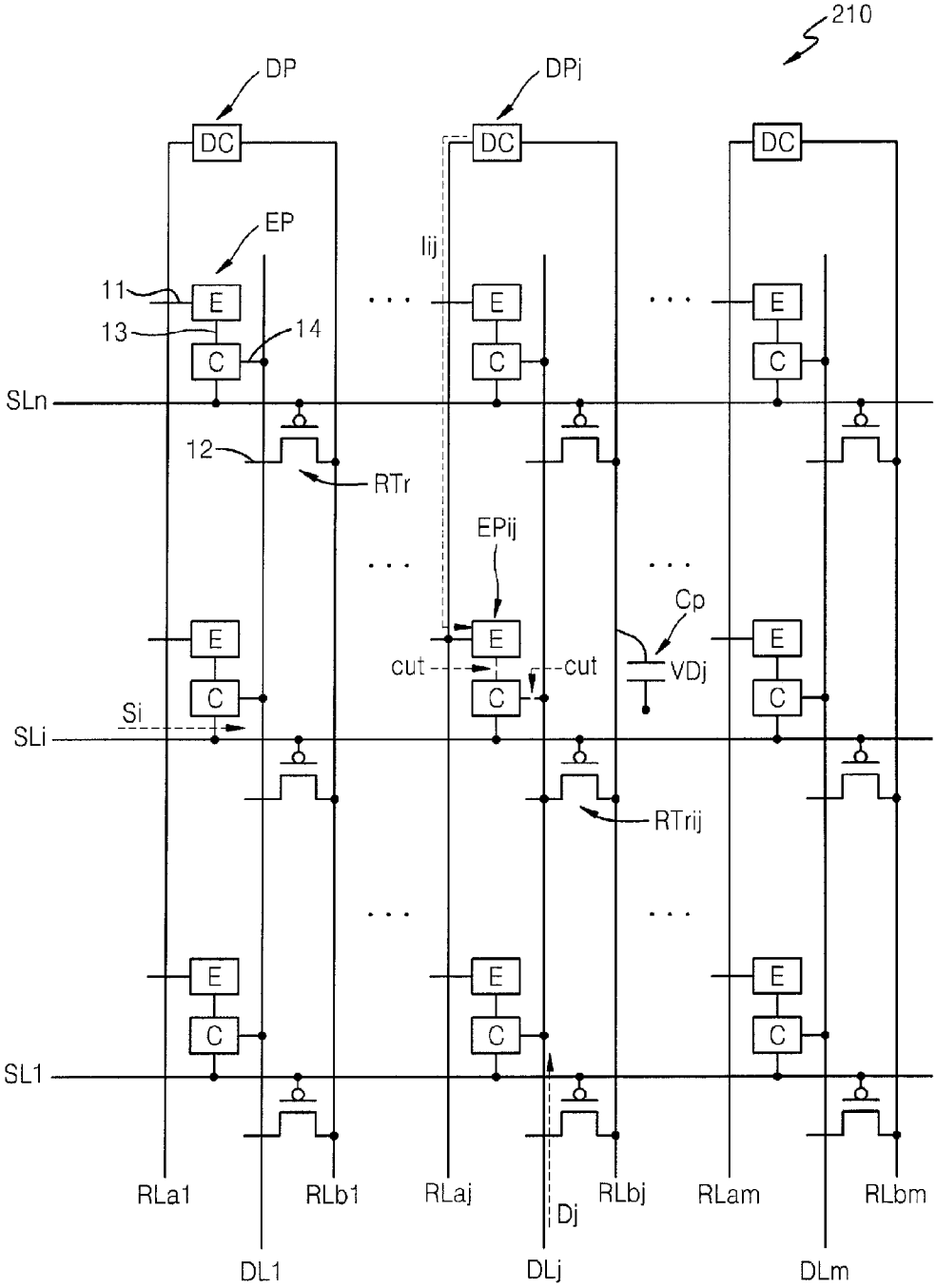
FIG. 9 illustrates an example of a display panel of FIG. 8, according to an embodiment of the present invention.

FIG. 9 illustrates an example of the display panel 210 of FIG. 8, according to an embodiment of the present invention.

Referring to FIG. 9, the display panel 210 is substantially the same as the display panel 110 of FIG. 2, except that the display panel 210 does not include the dummy scan line SLn+1. Hereinafter, differences therebetween are mainly described below.

The display panel 210 includes a plurality of emitting pixels EP, a plurality of dummy pixels DP, a plurality of first repair lines RLa1-RLam, a plurality of second repair lines RLb1-RLbm, and a plurality of repair switching devices RTr. The emitting pixels EP are coupled to a plurality of scan lines SL1-SLn that extend in a row direction and a plurality of data lines DL1-DLm that extend in a column direction, and are matrix-arrayed on the display panel 210. The dummy pixels DP are arrayed in the row direction on the display panel 210. The first repair lines RLa1-RLam extend in the column direction, are coupled to the dummy pixels DP, and are adapted to be coupled to the emitting pixels EP. The second repair lines RLb1-RLbm extend in the column direction and are adapted to be coupled to the dummy pixels DP. The repair switching devices RTr are coupled to the scan lines SL1-SLn and the second repair lines RLb1-RLbm, are adapted to be coupled to the data lines DL1-DLm, and are matrix-arrayed on the display panel 210.

Each of the emitting pixels EP includes an emitting device E and a pixel circuit C that is separably coupled to the emitting device E. Each of the dummy pixels DP includes a dummy pixel circuit DC.

For convenience of description, an emitting pixel EPij and a dummy pixel DPj that is positioned at the same column as the emitting pixel EPij are mainly described. The descriptions about the emitting pixel EPij and the dummy pixel DPj may be equally applied to the rest of the emitting pixels EP and dummy pixels DP.

A pixel circuit C of the emitting pixel EPij is coupled to a scan line, and a data line DLj. In response to a scan signal Si that is transferred via the scan line SLi, the pixel circuit C receives a data signal Dj transferred via the data line DLj, generates a driving current corresponding to the data signal Dj and then provides the driving current to the emitting device E. The emitting device E receives the driving current and emits light with a brightness corresponding to the data signal Dj.

The emitting device E and the pixel circuit C may be coupled via a separable wire 13 that may be easily separated. The pixel circuit C of the emitting pixel EPij may be separably coupled to the data line DLj. The pixel circuit C may be coupled to the data line DLj via a separable wire 14. The emitting device E of the emitting pixel EPij is adapted to be coupled to a first repair line RLaj. The emitting device E may be coupled to the first repair line RLaj via a connectable wire 11.

A repair switching device RTrij includes a control terminal that is coupled to the scan line SLi, a first connection terminal that is coupled to a corresponding second repair line RLbj, and a second connection terminal that is adapted to be coupled to the data line DLj. The second connection terminal may be coupled to the corresponding data line DLj via a connectable wire 12.

The dummy pixel DPj is coupled to the first repair line RLaj and the second repair line RLbj.

It is assumed that the emitting pixel EPij that is coupled to the scan line SLi and the data line DLj is a defective pixel, and hereinafter, the emitting pixel EPij that is the defective pixel is referred as a defective pixel EPij. The defective pixel EPij is repaired by using the dummy pixel DPj and therefore is enabled to operate normally.

An emitting device E of the defective pixel EPij is separated from a pixel circuit C. In an embodiment, the pixel circuit C of the defective pixel EPij may be separated from the data line DLj.

The first repair line RLaj is coupled to the emitting device E of the defective pixel EPij. The repair switching device RTrij that corresponds to the defective pixel EPij is coupled to the data line DLj.

When the scan signal Si that is transferred via the scan line SLi is activated, the data signal Dj is applied to the data line DLj. In response to the scan signal Si, the repair switching device RTrij transfers the data signal Dj to the second repair line RLbj. The second repair line RLbj includes a parasitic capacitor Cp that equivalently exists. The parasitic capacitor Cp stores a dummy data voltage VDj that corresponds to the data signal Dj.

A dummy pixel circuit DC of the dummy pixel DPj generates a driving current Iij that corresponds to the data signal Dj, based on the dummy data voltage VDj stored in the parasitic capacitor Cp of the second repair line RLbj. The dummy pixel circuit DC provides the driving current Iij to the emitting device E of the defective pixel EPij. The emitting device E of the defective pixel EPij emits light with a brightness corresponding to the data signal Dj, based on the driving current Iij.

Figure 10:
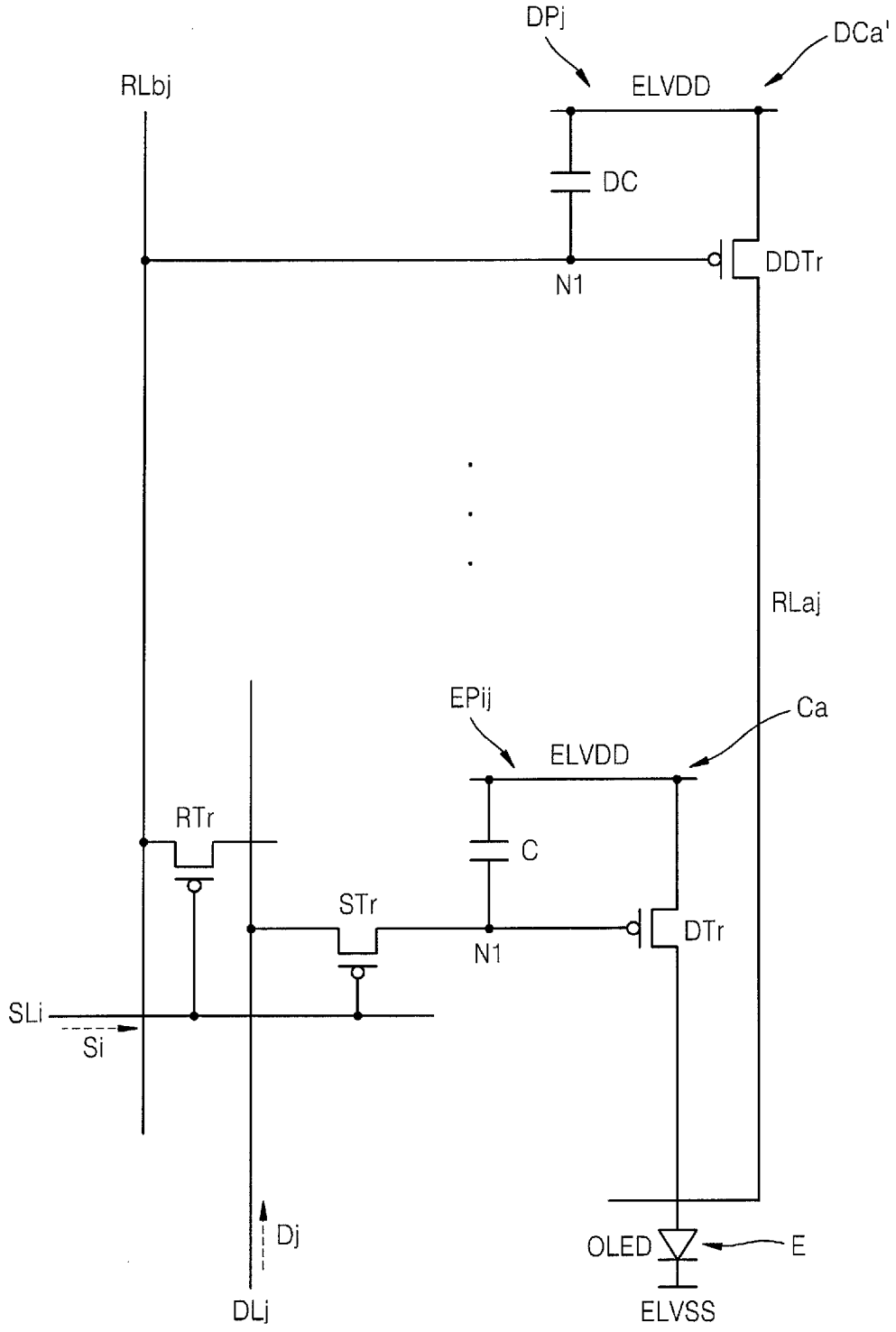
FIG. 10 illustrates a circuit configuration of an emitting pixel and a dummy pixel that may be applied to the display panel shown in FIG. 8, according to an embodiment of the present invention.

FIG. 10 illustrates a circuit configuration of an emitting pixel EPij and a dummy pixel DPj that may be applied to the display panel 210 shown in FIG. 8, according to an embodiment of the present invention.

Referring to FIG. 10, the emitting pixel EPij has a same configuration as that of the emitting pixel EPij shown in FIG. 5. Thus, the detailed descriptions about the emitting pixel EPij are omitted here.

The dummy pixel DPj includes a dummy pixel circuit DCa'. The dummy pixel circuit DCa' includes a dummy driving transistor DDTr and a dummy capacitor DC. The dummy driving transistor DDTr and the dummy capacitor DC correspond to a driving transistor DTr and a capacitor C of the emitting pixel EPij, respectively.

A first node N1 to which a gate electrode of the dummy driving transistor DDTr and the dummy capacitor DC are coupled is coupled to a second repair line RLbj. A second electrode of the dummy driving transistor DDTr is coupled to a first repair line RLaj. The first repair line RLaj is adapted to be coupled to an anode electrode of an emitting device E. A repair switching device RTr includes a gate electrode that is coupled to a scan line SLi, a first electrode that is coupled to the second repair line RLbj, and a second electrode that is adapted to be coupled to a data line DLj.

When a defect occurs in a pixel circuit Ca of the emitting pixel EPij, the pixel circuit Ca and the emitting device E are separated. The first repair line RLaj is coupled to the anode electrode of the emitting device E, and the second electrode of the repair switching device RTr is coupled to the data line DLj.

When a scan signal Si is activated, a data signal Dj is transferred to the second repair line RLbj via the repair switching device RTr. The second repair line RLbj stores a dummy data voltage that corresponds to the data signal Dj. Because the first node N1 is coupled to the second repair line RLbj, a voltage that corresponds to the dummy data voltage is charged in the dummy capacitor DC. The dummy driving transistor DDTr generates a driving current corresponding to the voltage charged in the dummy capacitor DC, and therefore provides the driving current to the emitting device E. The emitting device E emits light with a brightness that corresponds to the data signal Dj, according to the driving current that is supplied by the dummy driving transistor DDTr of the dummy pixel circuit DCa'.

Figure 11:
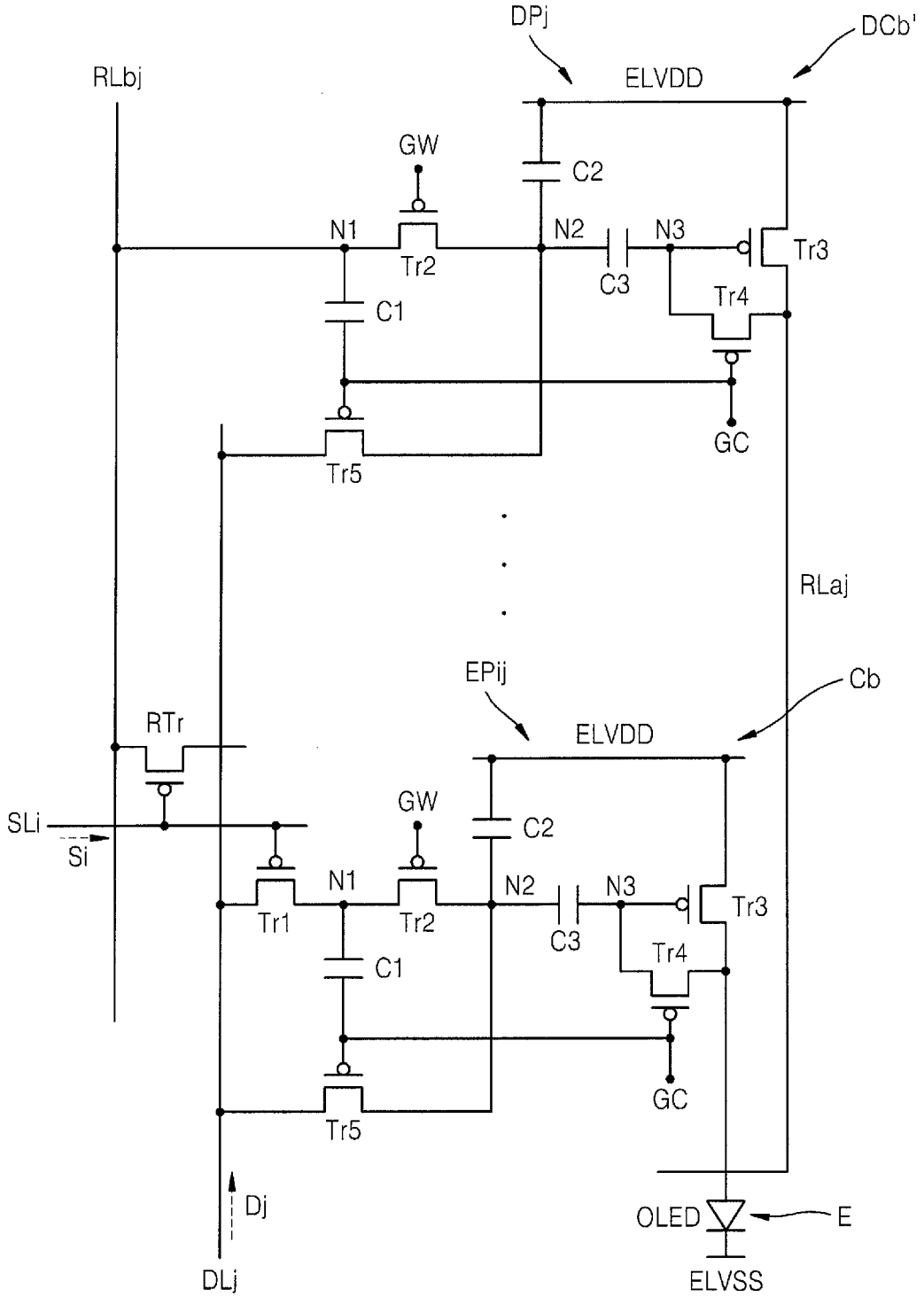
FIG. 11 illustrates a circuit configuration of an emitting pixel and a dummy pixel that may be applied to the display panel shown in FIG. 8, according to another embodiment of the present invention.

FIG. 11 illustrates a circuit configuration of an emitting pixel EPij and a dummy pixel DPj that may be applied to the display panel 210 shown in FIG. 8, according to another embodiment of the present invention.

Referring to FIG. 11, the emitting pixel EPij has a same configuration as that of the emitting pixel EPij shown in FIG. 6. Thus, the detailed descriptions about the emitting pixel EPij are omitted here.

The dummy pixel DPj includes a dummy pixel circuit DCb'. The dummy pixel circuit DCb' includes four transistors, i.e., second through fifth transistors Tr2-Tr5, and three capacitors, i.e., first through third capacitors C1-C3. The dummy pixel circuit DCb' has the same configuration as that of the dummy pixel circuit DCb shown in FIG. 6, except that a first transistor Tr1 is omitted and a first node N1 is directly coupled to a second repair line RLbj in the dummy pixel circuit DCb'.

When a defect occurs in a pixel circuit Cb of the emitting pixel EPij, the pixel circuit Cb and the emitting device E are separated. A first repair line RLaj is coupled to an anode electrode of the emitting device E, and a second electrode of a repair switching device RTr is coupled to a data line DLj.

During scan/emission periods of a previous frame, when a scan signal Si is activated, a data signal Dj is transferred to the second repair line RLbj via the switching device RTr. The second repair line RLbj stores a dummy data voltage that corresponds to the data signal Dj. Because the first node N1 is coupled to the second repair line RLbj, a voltage corresponding to the dummy data voltage is charged in the first capacitor C1 of the dummy pixel DPj. Similarly to the pixel circuit Cb, in the dummy pixel circuit DCb', an initialization period, a compensation period, and a data transfer period proceed. During the data transfer period, the voltage that is charged in the first capacitor C1 of the dummy pixel DPj is transferred to a second node N2, during the scan/emission periods, the third transistor Tri of the dummy pixel circuit DCb' is turned on and therefore a current path between a first power voltage ELVDD and a cathode electrode of an organic light emitting diode OLED of the emitting pixel EPij is established, and the organic light emitting diode OLED of the emitting pixel EPij emits light with a brightness corresponding to the data signal Dj that is received during the scan/emission periods of the previous frame.

Figure 12:
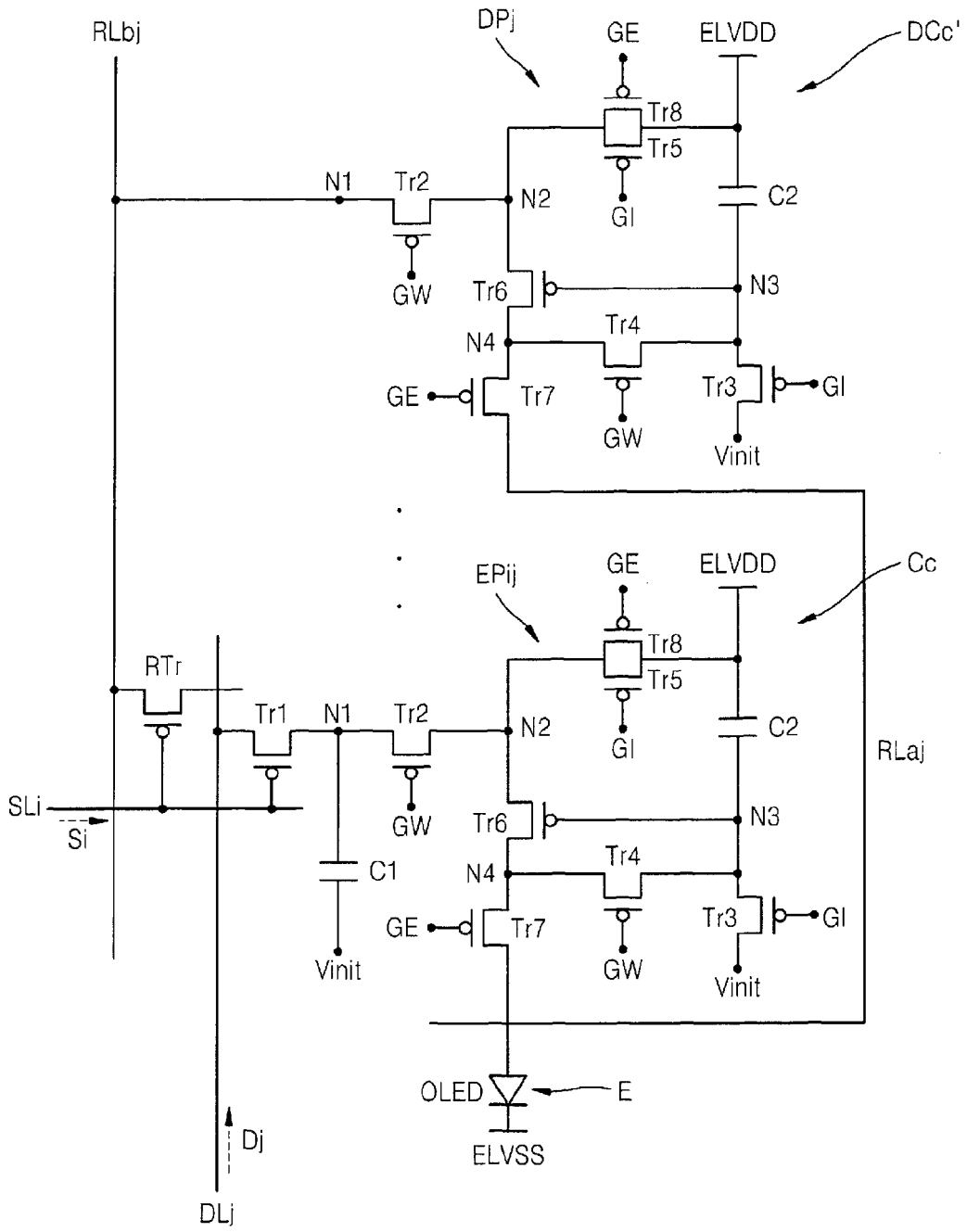
FIG. 12 illustrates a circuit configuration of an emitting pixel and a dummy pixel that may be applied to the display panel shown in FIG. 8, according to another embodiment of the present invention.

FIG. 12 illustrates a circuit configuration of an emitting pixel EPij and a dummy pixel DPj that may be applied to the display panel 210 shown in FIG. 8, according to another embodiment of the present invention.

Referring to FIG. 12, the emitting pixel EPij has a same configuration as that of the emitting pixel EPij shown in FIG. 7. Thus, the detailed descriptions about the emitting pixel EPij are omitted here.

The dummy pixel DPj includes a dummy pixel circuit DCc'. The dummy pixel circuit DCc' includes seven transistors, i.e., second through seventh transistors Tr2-Tr7, and two capacitors, i.e., first and second capacitors C1 and C2. The dummy pixel circuit DCc' has the same configuration as that of the dummy pixel circuit DCb shown in FIG. 7, except that a first transistor Tr1 is omitted and a first node N1 is directly coupled to a second repair line RLbj in the dummy pixel circuit DCb'.

When a defect occurs in a pixel circuit Cc of the emitting pixel EPij, the pixel circuit Cc and the emitting device E are separated. A first repair line RLaj is coupled to an anode electrode of the emitting device E, and a second electrode of a repair switching device RTr is coupled to a data line DLj. A first electrode of the first transistor Tr1 of the pixel circuit Cc may be separated from the data line DLj.

During scan/emission periods of a previous frame, when a scan signal Si is activated, a data signal Dj is transferred to the second repair line RLbj via the switching device RTr. The second repair line RLbj stores a dummy data voltage that corresponds to the data signal Dj. Because the first node N1 is coupled to the second repair line RLbj, the dummy data voltage is charged in the first node N1. Similarly to the pixel circuit Cc, in the dummy pixel circuit DCc', an initialization period, and compensation/data transfer periods proceed. During the data transfer period, the dummy data voltage that is charged in the first node N1 is transferred to a second node N2, and during scan/emission periods, the sixth transistor Tr6 of the dummy pixel circuit DCc' is turned on and therefore a current path between a first power voltage ELVDD and a cathode electrode of an organic light emitting diode OLED of the emitting pixel EPij is established, and the organic light emitting diode OLED of the emitting pixel EPij emits light with a brightness corresponding to the data signal Dj that is received during the scan/emission periods of the previous frame.

In another embodiment, the dummy pixel circuit DCc' may further include a third capacitor (not shown) that corresponds to the first capacitor C1 of the pixel circuit Cc, and is coupled between the first node N1 and an initialization power source that supplies an initialization voltage Vint. During the scan/emission periods, the third capacitor stores a voltage that corresponds to the dummy data voltage charged in the second repair line RLbj.

Figure 13:
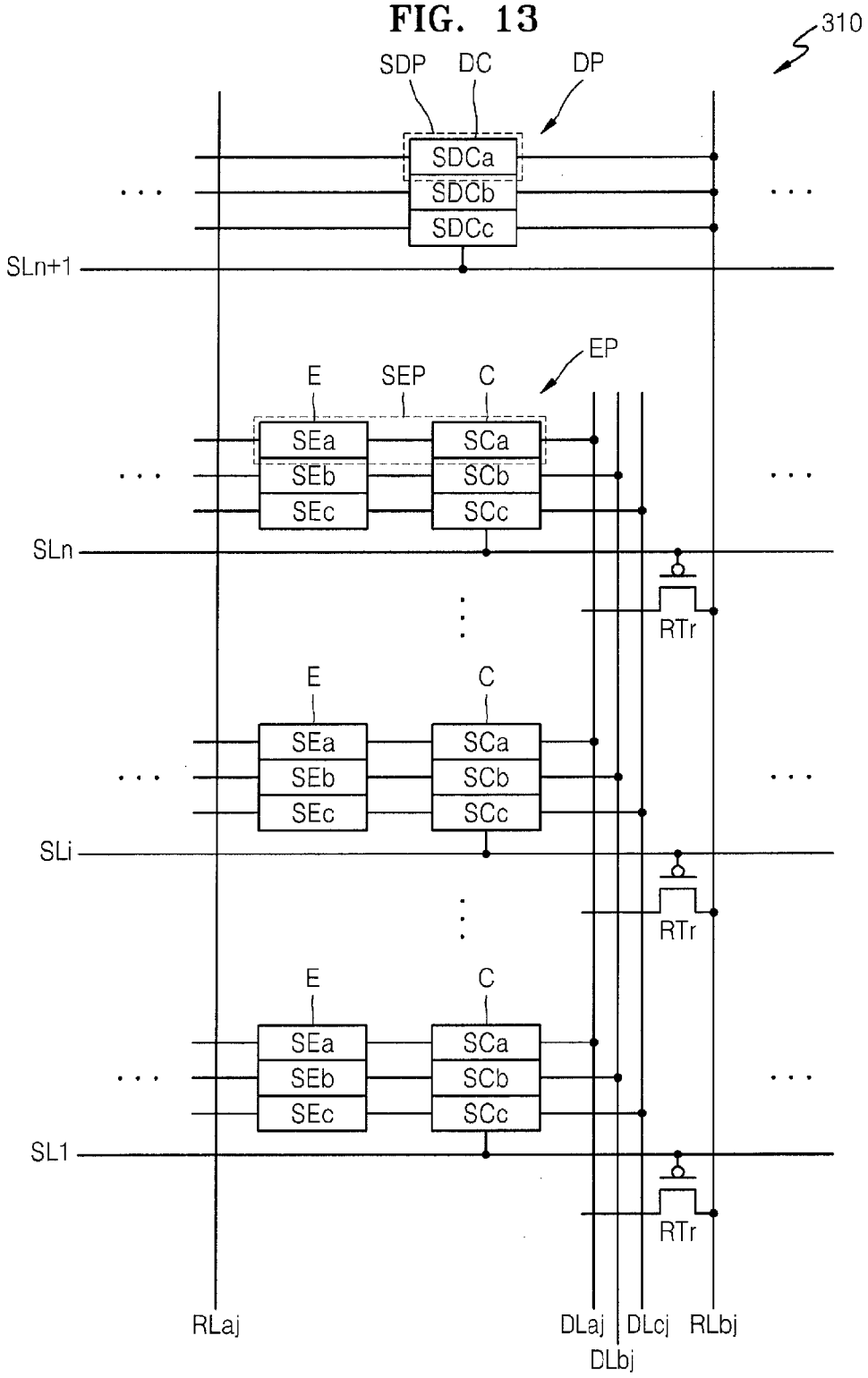
FIG. 13 illustrates a display panel of the organic light-emitting display apparatus, according to another embodiment of the present invention.

FIG. 13 illustrates a display panel 310 of the organic light-emitting display apparatus, according to another embodiment of the present invention.

Referring to FIG. 13, the display panel 310 includes a plurality of matrix-arrayed emitting pixels EP and a plurality of dummy pixels DP that are arrayed in a row direction. Each of the emitting pixels EP includes a plurality of sub-emitting pixels SEP. Referring to FIG. 13, one emitting pixel EP includes three sub-emitting pixels SEP but one or more embodiments of the present invention are not limited thereto.

Each of the sub-emitting pixels SEP that are included in one emitting pixel EP includes first through third sub-emitting pixels SEa, SEb, and SEc, and first through third sub-pixel circuits SCa, SCb, and SCc. The first through third sub-pixel circuits SCa, SCb, and SCc are separably coupled to the first through third sub-emitting pixels SEa, SEb, and SEc, respectively. The first through third sub-emitting pixels SEa, SEb, and SEc may include organic light emitting diodes that emit different colors of light, respectively. For example, the first sub-emitting pixel SEa may include a red-color organic light emitting diode that emits a red color of light, the second sub-emitting pixel SEb may include a green-color organic light emitting diode that emits a green color of light, and the third sub-emitting pixel SEa may include a blue-color organic light emitting diode that emits a blue color of light. The first through third sub-pixel circuits SCa, SCb, and SCc may include driving transistors, respectively, that have current drive abilities appropriate for the first through third sub-emitting pixels SEa, SEb, and SEc, respectively. The pixel circuits Ca, Cb, and Cc shown in FIGS. 5 through 7 may be used as the first through third sub-pixel circuits SCa, SCb, and SCc.

The sub-dummy pixels SDP included in one dummy pixel DP include first through third sub-dummy pixel circuits SDCa, SDCb, and SDCc. The first through third sub-dummy pixel circuits SDCa, SDCb, and SDCc may correspond to the first through third sub-pixel circuits SCa, SCb, and SCc, respectively. For example, the first through third sub-dummy pixel circuits SDCa, SDCb, and SDCc may have current driving capabilities appropriate for the first through third sub-emitting pixels SEa, SEb, and SEc, respectively. The dummy pixel circuits DCa, DCb, and DCc shown in FIGS. 5 through 7 may be used as the first through third sub-dummy pixel circuits SDCa, SDCb, and SDCc.

A plurality of scan lines SL1-SLn and a dummy scan line SLn+1 that extend in a row direction are located in the display panel 310. Each of the first through third sub-pixel circuits SCa, SCb, and SCc is coupled to a corresponding scan line from among the scan lines SL1-SLn.

A plurality of data lines including first through third data lines DLaj, DLbj, and DLcj that extend in the row direction are located in the display panel 310. The first data line DLaj is coupled to the first sub-pixel circuit SCa, the second data line DLbj is coupled to the second sub-pixel circuit SCb, and the third data line DLcj is coupled to the third sub-pixel circuit SCc. The first data line DLaj and the first sub-pixel circuit SCa may be separably coupled to each other, the second data line DLbj and the second sub-pixel circuit SCb may be separably coupled to each other, and the third data line DLcj and the third sub-pixel circuit SCc may be separably coupled to each other.

A plurality of first repair lines including a first repair line RLaj that extends in a column direction are located in the display panel 310. The first repair lines are adapted to be coupled to the sub-emitting pixels SEP of each emitting pixel EP, which are positioned at the same columns, respectively, and are also adapted to be coupled to the sub-dummy pixels SDP of each dummy pixel DP, which are disposed at the same columns, respectively. The first repair lines are adapted to be coupled to the first through third sub-emitting pixels SEa, SEb, and SEc that are positioned at the same columns, respectively, and also are adapted to be coupled to the first through third sub-dummy pixel circuits SDCa, SDCb, and SDCc that are positioned at the same columns, respectively.

A plurality of second repair lines including a second repair line RLbj that extends in the column direction are positioned in the display panel 310.

In the display panel 310, a plurality of repair switching devices RTr are positioned while the repair switching devices RTr are coupled to the scan lines SL1-SLn and the second repair lines RLb, and are adapted to be coupled to the data lines. The repair switching devices RTr are matrix-arrayed while corresponding to the emitting pixels EP. Each of the repair switching devices RTr includes a control terminal that is coupled to a corresponding scan line from among the scan lines SL1-SLn, a second connection terminal that is coupled to a corresponding second repair line from among the second repair lines, and a first connection terminal that is adapted to be coupled to the first through third data lines DLaj, DLbj, and DLcj from among the data lines.

The second repair lines are coupled to the repair switching devices RTr that are positioned at the same columns, respectively, and also are coupled to the sub-dummy pixels SDP of each dummy pixel DP, e.g., the first through third sub-dummy pixel circuits SDCa, SDCb, and SDCc that are positioned at the same columns, respectively.

Similarly to the organic light-emitting display apparatus 200 shown in FIG. 8, in another embodiment, the dummy scan line SLn+1 may be omitted in the display panel 310. In this case, the dummy pixel circuits DCa', DCb', and DCc' shown in FIGS. 10 through 12 may be used as the first through third sub-dummy pixel circuits SDCa, SDCb, and SDCc.

Figure 14:
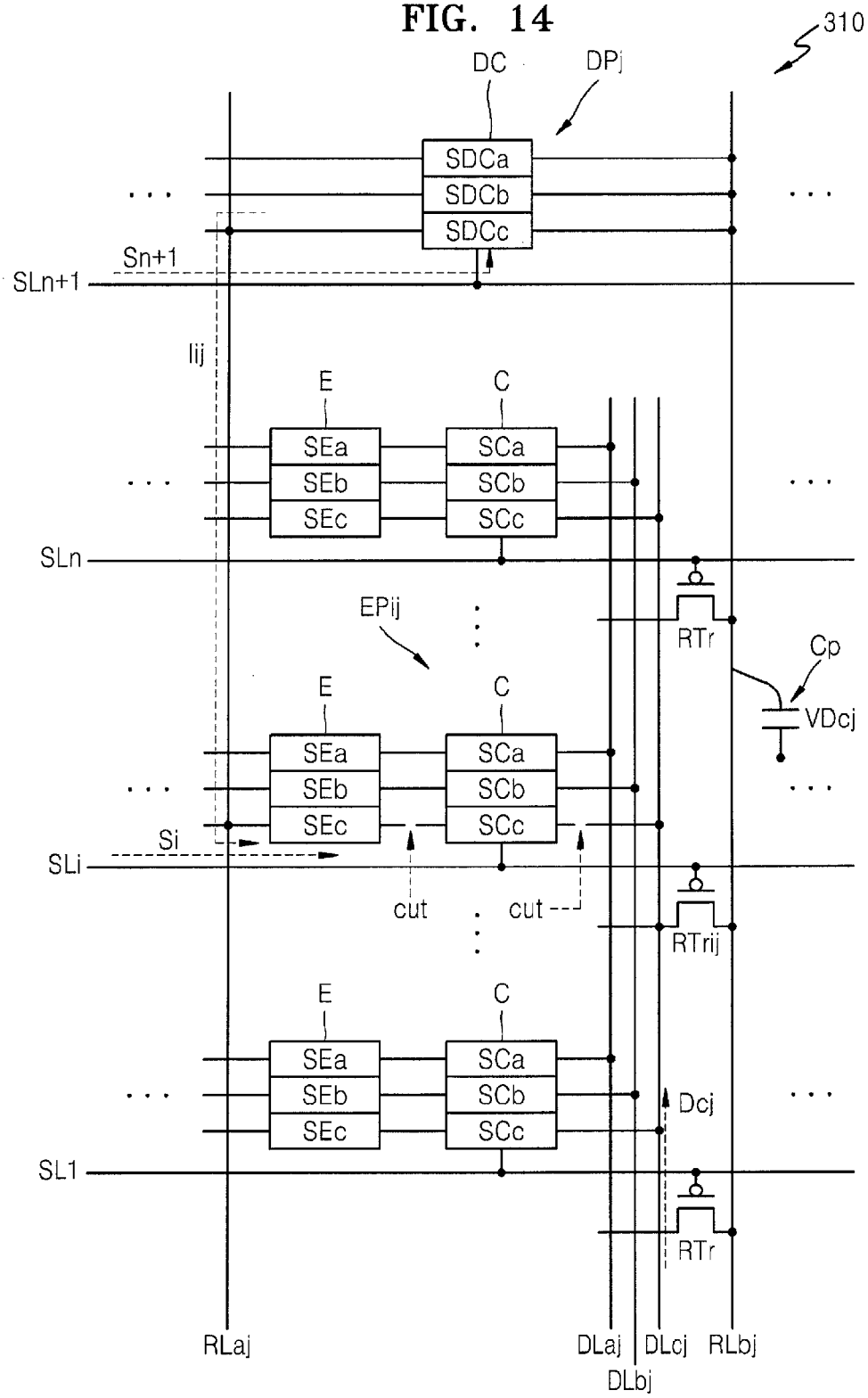
FIG. 14 illustrates a method of repairing a defective pixel in the display panel shown in FIG. 13.

FIG. 14 illustrates a method of repairing a defective pixel in the display panel 310 shown in FIG. 13.

It is assumed that a third sub-pixel circuit SCc of an emitting pixel EPij that is coupled to a scan line SLi and a data line DLj is a defective pixel. Hereinafter, a sub-emitting pixel of the emitting pixel EPij which includes the third sub-pixel circuit SCc is referred as a defective sub-emitting pixel, and the third sub-pixel circuit SCc of the emitting pixel EPij is referred as a defective sub-pixel circuit. A third sub-emitting device SEc of the defective sub-emitting pixel is repaired by using a third sub-dummy pixel circuit SDCc of a dummy pixel DPj and therefore normally emits light.

The third sub-emitting device SEc of the defective sub-emitting pixel is separated from the defective sub-pixel circuit. For example, the third sub-emitting device SEc of the defective sub-emitting pixel and the defective sub-pixel circuit may be separated from each other by using laser cutting. In an embodiment, the defective sub-pixel circuit of the defective sub-emitting pixel may be separated or electrically isolated from the data line DLj by using laser cutting.

A first repair line RLaj may be coupled to the third sub-emitting device SEc of the defective sub-emitting pixel by using a laser. Also, the first repair line RLaj may be coupled to the third sub-dummy pixel circuit SDCc of the dummy pixel DPj in a manner that a laser is irradiated to an overlapping area.

A repair switching device RTrij may be coupled to a third data line DLcj by using a laser.

When a scan signal Si that is transferred via a scan line SLi is activated, a data signal Dcj is applied to the third data line DLcj. In response to the scan signal Si, the repair switching device RTrij transfers the data signal Dcj to a second repair line RLbj. The second repair line RLbj includes a parasitic capacitor Cp that equivalently exists. The parasitic capacitor Cp stores a dummy data voltage VDcj that corresponds to the data signal Dcj.

When a scan signal Sn+1 is activated via a dummy scan line SLn+1, the third sub-dummy pixel circuit SDCc of the dummy pixel DPj receives the dummy data voltage VDcj charged in the parasitic capacitor Cp of the second repair line RLbj, and generates a driving current Iij that corresponds to the dummy data voltage VDcj.

For example, the third sub-dummy pixel circuit SDCc of the dummy pixel DPj may include a dummy switching transistor that transfers the dummy data voltage VDcj charged in the second repair line RLbj in response to a dummy scan signal Sn+1; a dummy capacitor that charges a voltage corresponding to the dummy data voltage VDcj; and a dummy driving transistor that transfers the driving current Iij, which corresponds to the voltage charged in the dummy capacitor, to the third sub-emitting device SEc of the defective sub-emitting pixel.

The third sub-dummy pixel circuit SDCc of the dummy pixel DPj provides the driving current Iij to the third sub-emitting device SEc of the defective sub-emitting pixel. The third sub-emitting device SEc of the defective sub-emitting pixel emits light with a brightness corresponding to the data signal Dcj, based on the driving current Iij.

In the other embodiment, as described above, the dummy scan line SLn+1 may be omitted in the display panel 310. In this case, when the scan signal Si that is transferred via the scan line SLi is activated, the data signal Dcj is applied to the third data line DLcj. The repair switching device RTrij transfers the data signal Dcj to the second repair line RLbj, in response to the scan signal Si. The second repair line RLbj includes the parasitic capacitor Cp that equivalently exists. The parasitic capacitor Cp stores the dummy data voltage VDcj that corresponds to the data signal Dcj.

The third sub-dummy pixel circuit SDCc of the dummy pixel DPj generates the driving current Iij that corresponds to the dummy data voltage VDcj charged in the parasitic capacitor Cp of the second repair line RLbj.

For example, the third sub-dummy pixel circuit SDCc of the dummy pixel DPj may include a dummy capacitor that charges a voltage corresponding to the dummy data voltage VDcj that is charged in the second repair line RLbj; and a dummy driving transistor that transfers a driving current Iij, which corresponds to the voltage charged in the dummy capacitor, to the third sub-emitting device SEc of the defective sub-emitting pixel.

The third sub-dummy pixel circuit SDCc of the dummy pixel DPj provides the driving current Iij to the third sub-emitting device SEc of the defective sub-emitting pixel. The third sub-emitting device SEc of the defective sub-emitting pixel emits light with a brightness corresponding to the data signal Dcj, based on the driving current Iij.

As described above, according to the one or more of the above embodiments of the present invention, a data voltage that was supposed to be provided to a defective pixel is provided to a dummy pixel via a repair line (e.g., a parasitic capacitor of the repair line), so that it is possible to repair the defective pixel by using the dummy pixel without adjusting a timing controller or adding a memory.

It should be understood that the example embodiments described herein should be considered in a descriptive sense only and not for purposes of limitation. Descriptions of features or aspects within each embodiment should be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims, and their equivalents.

What is claimed is:

1. An organic light-emitting display apparatus comprising:

a plurality of emitting pixels coupled to a plurality of scan lines extending in a row direction and a plurality of data lines extending in a column direction;

a plurality of dummy pixels arranged in the row direction;

a plurality of first repair lines extending in the column direction, that are coupled to the plurality of dummy pixels, and that are adapted to be coupled to the plurality of emitting pixels;

a plurality of second repair lines extending in the column direction, and that are coupled to the plurality of dummy pixels; and a plurality of repair switching devices arranged in a matrix array and adapted-to be coupled to the plurality of scan lines and adapted to be coupled between the plurality of second repair lines and the plurality of data lines, wherein the plurality of repair switching devices each has a control terminal that is directly coupled to a corresponding one of the scan lines, a first connection terminal that is directly coupled to one of a corresponding one of the second repair lines or a corresponding one of the data lines, and a second connection terminal that is adapted to be coupled directly to another of the corresponding one of the second repair lines or the corresponding one of the data lines.

2. The organic light-emitting display apparatus of claim 1, wherein each of the plurality of emitting pixels comprises an emitting device and a pixel circuit that is separably coupled to the emitting device, and wherein each of the plurality of dummy pixels comprises a dummy pixel circuit.

3. The organic light-emitting display apparatus of claim 2, wherein the pixel circuit comprises:

a switching transistor configured to transfer a data signal that is received via a corresponding data line from among the plurality of data lines, in response to a scan signal that is transferred via a corresponding scan line from among the plurality of scan lines;

a first capacitor configured to charge a voltage that corresponds to the data signal; and a driving transistor configured to transfer a driving current to the emitting device, wherein the driving current corresponds to the voltage that is charged in the first capacitor.

4. The organic light-emitting display apparatus of claim 2, wherein the plurality of emitting pixels comprises at least one defective pixel, wherein the at least one defective pixel is electrically isolated from a corresponding pixel circuit of the at least one defective pixel, is coupled to a corresponding first repair line from among the plurality of first repair lines, and is coupled to a dummy pixel from among the plurality of dummy pixels at a same column via the corresponding first repair line, and a data line from among the plurality of data lines, which corresponds to the at least one defective pixel, is coupled to the repair switching device from among the plurality of repair switching devices, which corresponds to the at least one defective pixel, and the data line is electrically coupled to a corresponding second repair line from among the plurality of second repair lines via the corresponding repair switching device.

5. The organic light-emitting display apparatus of claim 4, wherein the pixel circuit of the at least one defective pixel is electrically isolated from the corresponding data line.

6. The organic light-emitting display apparatus of claim 4, wherein the corresponding repair switching device is configured to transfer a data signal that is received via the corresponding data line to the corresponding second repair line in response to a scan signal that is transferred via a scan line from among the plurality of scan lines, which corresponds to the at least one defective pixel, and wherein the corresponding second repair line is configured to store a dummy data voltage that corresponds to the data signal.

7. The organic light-emitting display apparatus of claim 6, wherein the corresponding second repair line comprises a parasitic capacitor configured to store the dummy data voltage.

8. The organic light-emitting display apparatus of claim 6, wherein the dummy pixel circuit of the dummy pixel at a same column as the at least one defective pixel comprises a dummy driving current generating circuit configured to generate a driving current that corresponds to the dummy data voltage stored in the corresponding second repair line.

9. The organic light-emitting display apparatus of claim 8, wherein the dummy driving current generating circuit comprises:

a dummy capacitor configured to charge a voltage that corresponds to the dummy data voltage stored in the corresponding second repair line; and a dummy driving transistor configured to transfer the driving current that corresponds to the voltage charged in the dummy capacitor to the emitting device of the at least one defective pixel.

10. The organic light-emitting display apparatus of claim 9, wherein the dummy pixel circuit further comprises a dummy additional circuit coupled to the dummy capacitor and the dummy driving transistor, the dummy pixel circuit comprising at least one of a transistor and/or a second capacitor.

11. The organic light-emitting display apparatus of claim 10, wherein the dummy additional circuit is coupled to a data line corresponding to the at least one defective pixel.

12. The organic light-emitting display apparatus of claim 6, further comprising a dummy scan line extending in the row direction and coupled to a plurality of the dummy pixel circuits.

13. The organic light-emitting display apparatus of claim 12, wherein each of the plurality of the dummy pixel circuits comprises:

a dummy switching transistor configured to transfer the dummy data voltage stored in the corresponding second repair line from among the plurality of second repair lines, in response to a dummy scan signal that is transferred via the dummy scan line;

a dummy capacitor configured to charge a voltage that corresponds to the dummy data voltage; and a dummy driving transistor configured to transfer a driving current that corresponds to the voltage charged in the dummy capacitor to the emitting device of the at least one defective pixel.

14. The organic light-emitting display apparatus of claim 13, wherein each of the plurality of the dummy pixel circuits further comprises a dummy additional circuit coupled to the dummy switching transistor, the dummy capacitor, and the dummy driving transistor, and wherein the pixel circuit further comprises an additional circuit coupled to the switching transistor, the capacitor, and the driving transistor.

* * * * *